US005119617A

United States Patent [19]

Mojden et al.

[11] Patent Number: 5,119,617

[45] Date of Patent: Jun. 9, 1992

[54] MULTI-LANE INFEED COUNTER/BAGGER

[75] Inventors: Andrew E. Mojden; Wallace W. Mojden, both of Hinsdale, Ill.; Robert E. Darr, Orlando, Fla.; Richard P. Hoinacki, Chicago, Ill.

[73] Assignee: Fleetwood Systems Inc., Countryside, Ill.

[21] Appl. No.: 642,197

[22] Filed: Jan. 16, 1991

[51] Int. Cl.[5] ..... B65B 57/20; B65B 35/54

[52] U.S. Cl. ..... 53/500; 53/202; 53/532; 53/542; 53/573

[58] Field of Search ..... 53/500, 532, 542, 498, 53/571, 573, 202

[56] References Cited

U.S. PATENT DOCUMENTS

| | | | |
|---|---|---|---|
| 3,732,665 | 5/1973 | Pitts | 53/542 X |
| 3,878,948 | 4/1975 | Mojden et al. . | |
| 3,962,845 | 6/1976 | Mojden et al. | 53/542 X |
| 4,442,652 | 4/1984 | Wakamatsu et al. | 53/532 X |
| 4,537,010 | 1/1985 | Mojden et al. | 53/447 |
| 4,848,059 | 7/1989 | Müller | 53/532 |
| 4,979,870 | 12/1989 | Mojden et al. | 414/788.4 |
| 5,005,340 | 4/1991 | Mojden | 53/532 X |

FOREIGN PATENT DOCUMENTS 2133766 8/1984 United Kingdom ..... 53/532

*Primary Examiner*—James F. Coan

*Attorney, Agent, or Firm*—Trexler, Bushnell, Giangiorgi & Blackstone

[57] ABSTRACT

Apparatus for handling and packaging articles such as can ends is capable of receiving a continuous flow of articles and automatically delivering groups of articles of a prescribed number, disposed in a nested condition, to a packaging station. The apparatus comprises a plurality of generally parallel elongate lanes for simultaneously handling articles, one of the lanes being articles to the packaging station. A transport aligned for delivering arrangement linearly advances articles along at least the one aligned lane toward the packaging station. A pick-and-place device is selectively movable between positions in alignment with each of the lanes for selectively transferring articles to the one aligned lane from the other lanes. A control apparatus controls a predetermined sequence of operation of the transport arrangement and of the pick-and-place device for providing a substantially continuous supply of articles to the packaging station.

21 Claims, 19 Drawing Sheets

20
116
118
114
231
232
233
230
122
110
236
234
242
120
240
244
21
105

MULTI-LANE INFEED COUNTER/BAGGER

BACKGROUND OF THE INVENTION

The present invention relates generally to apparatus for handling and packaging articles such as can ends, and more specifically to apparatus capable of receiving a continuous flow of such articles, counting and separating out a group or stack of a predetermined number of articles and packaging the individual groups or stacks into individual packages.

Most users of cans, such as canneries, breweries and sqft drink bottlers do not manufacture the containers, but rather purchase the components from manufacturers who specialize in the fabrication of these components. Generally speaking, these can components include can bodies having at least one open end, and the can ends that are employed to close the bodies subsequent to the filling or canning operation. The can ends are packaged, shipped and handled separately from the can bodies, and the usual practice is to package and ship the ends in elongate kraft paper bags. The number of can ends per package varies depending upon the requirements of the end user. By way of example, for typical end users, each filled bag or package contains 300 or 600 can ends. In the quantities used in typical beverage operations (i.e., in the millions), the bottler finds it extremely important that an accurate count of ends be maintained in the packages.

Moreover, in the fabrication operation, typical can end fabrication machinery produces can ends at the rate of about eighteen hundred to thirty-six hundred per minute. Accordingly, it is important that the machinery for counting and separating the ends into groups and packaging the same in kraft paper bags operate as rapidly as possible to keep pace with the fabrication equipment. As a related matter, the can ends must be handled in a continuous flow or stream and thereupon counted and separated with the ends in facewise nested engagement throughout the handling thereof up to and including the bagging operation. Should the groups or stacks of ends begin to separate, one or more ends may overturn which can lead to serious disruption of a high speed, high quantity packaging operation. For example, the overturning or dislodging of but a single end can result in a jamming or disrupting of automated equipment, leading to considerable down time. One such dislodged end may cause an entire stack or group of 300 or more ends to become dislodged and, quite literally, be thrown in every direction, thus seriously disrupting the bagging operation.

The problems and need for providing apparatus where can ends can be reliably packaged at high speed and with accurate count have been recognized and met, for example, in prior U.S. Pat. No. 3,878,948 and 4,537,010, both assigned to Fleetwood Systems, Inc., the owner of the present application. Reference is invited to these prior patents for further discussion of the prior art problems and the manner in which these problems are solved by the novel equipment described therein.

While the equipment described and claimed in the above-referenced patents has met with considerable commercial success, there remains room for further improvement. With ever-increasing speeds of operation of can end fabricating equipment, yet higher speeds of operation of the associated counting, separating and bagging equipment is required. Heretofore it has been the practice to employ several bagging lines to service a single end press or end fabrication line. However, the bagging equipment is relatively complex and expensive. Moreover, each bagging station or bagging line requires a separate operator which adds further to the expense of operation in this fashion. As a related matter, bagging equipment heretofore employed generally operates on a single incoming stream of can ends. Thus, in the event of any slow down or disruption of this incoming stream, the bagging components may stand idle over substantial periods of time. Given the expense of purchasing, operating and maintaining the bagging equipment, it is desirable to minimize such idle time of the equipment. On the other hand, the packaging capabilities of the bagging equipment may sometimes exceed the ability of a single incoming stream to supply successive groups of can ends for packaging.

Some improvement is also possible in the speed and accuracy of handling of associated bags, and in supplying the individual bags from a magazine or other source of supply to the bag filling equipment. Given the speed and accuracy of the bag filling equipment, it is important to provide a relatively reliable and rapid supply of empty bags to the equipment and to efficiently and quickly remove filled bags and replace the same with empty bags to insure an optimum speed of operation.

OBJECTS OF THE INVENTION

Accordingly, it is a general object of this invention to provide a novel and improved packaging apparatus for packaging groups of articles such as can ends.

A related object is to provide novel and improved packaging apparatus which is capable of providing both articles to be packaged and packages for receiving the same in a reliable, high-speed operation to the packaging equipment.

BRIEF DESCRIPTION OF THE DRAWINGS

The features of the present invention which are believed to be novel are set forth with particularity in the appended claims. The organization and manner of operation of the invention, together with further objects and advantages thereof may best be understood by reference to the following description, taken in connection with the accompanying drawings in which like reference numerals identify like elements, and in which:

DESCRIPTION OF THE ILLUSTRATED EMBODIMENT

Figure 1A:
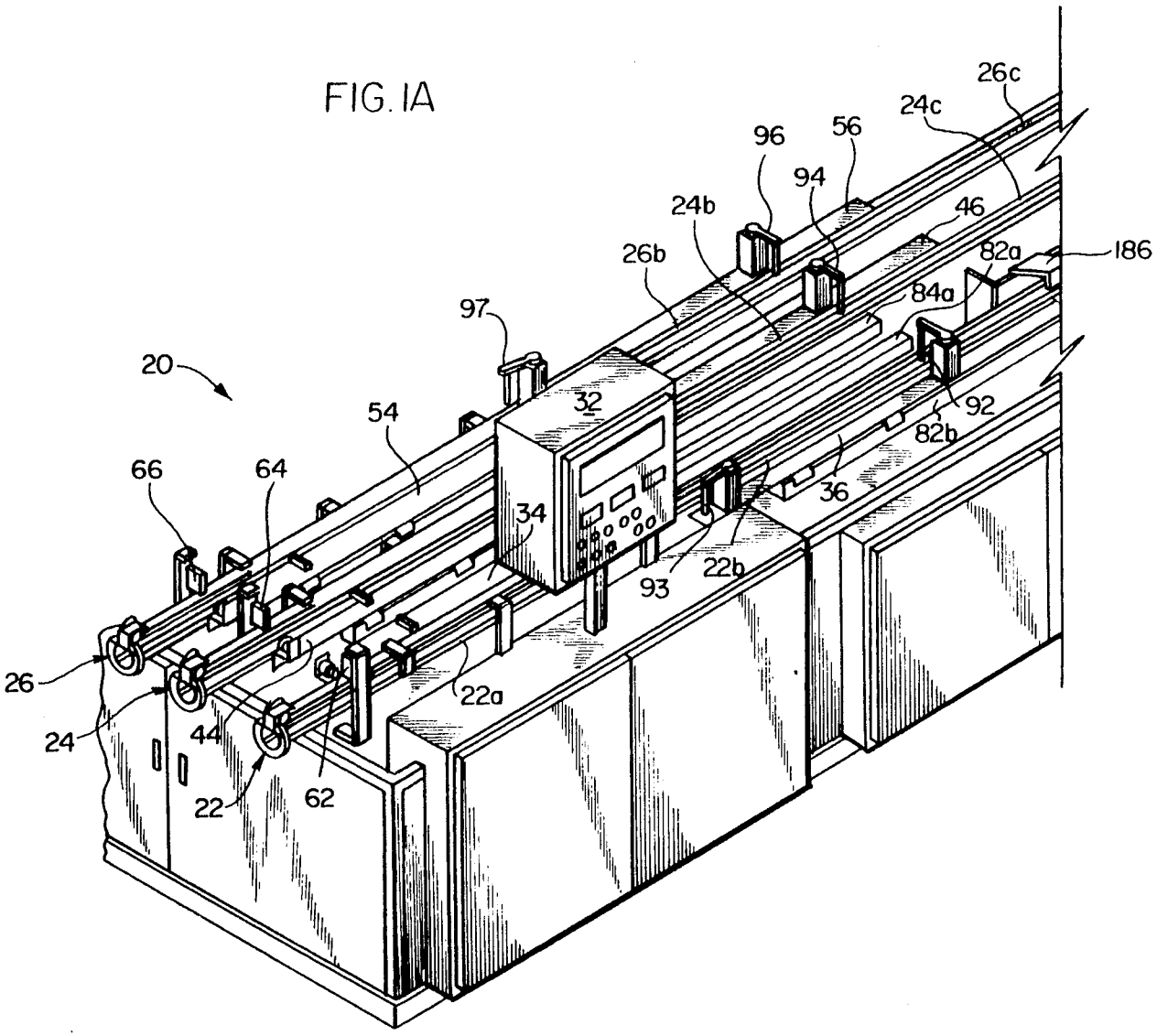
FIGS. 1A and 1B, taken together, form a perspective view of a multi-lane infeed counter/bagger in accordance with the invention.
Figure 1B:
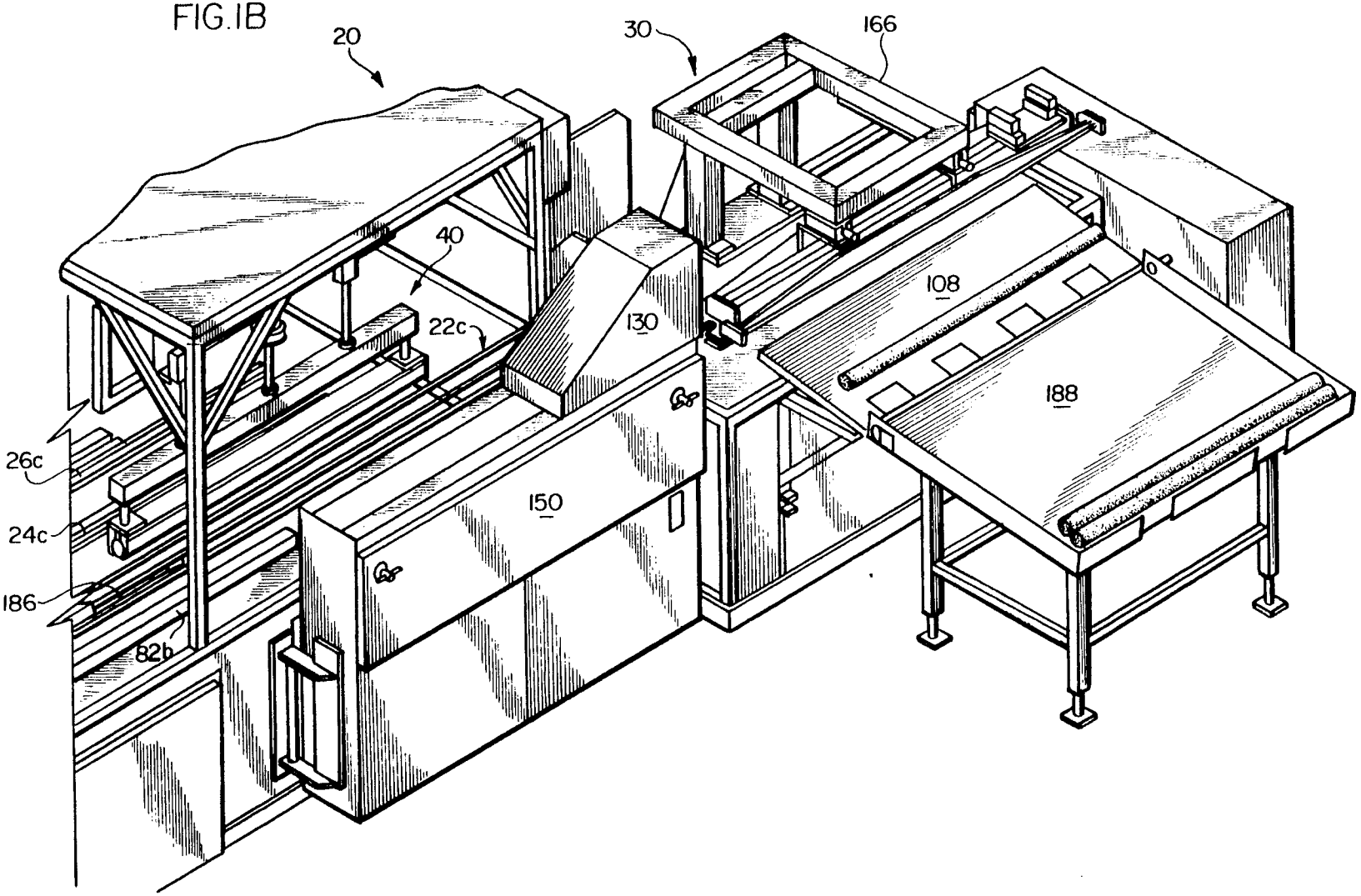

Referring now to the drawings, and initially to FIGS. 1A and 1B, a multi-lane infeed counter/bagger in accordance with the invention is illustrated in a perspective view. While the invention is illustrated and described herein with reference to the multi-lane infeed counter/-bagger, it will be understood that the principles of the invention are applicable generally to apparatus for handling and packaging articles such as can ends. Accordingly, the apparatus is capable of receiving a continuous flow of such articles and automatically delivering groups of articles of a prescribed or predetermined number disposed in a facewise nested or stacked condition to a packaging station. In the illustrated embodiment, this packaging station or portion is fully illustrated in FIGS. 1B and 10B.

Figure 2:
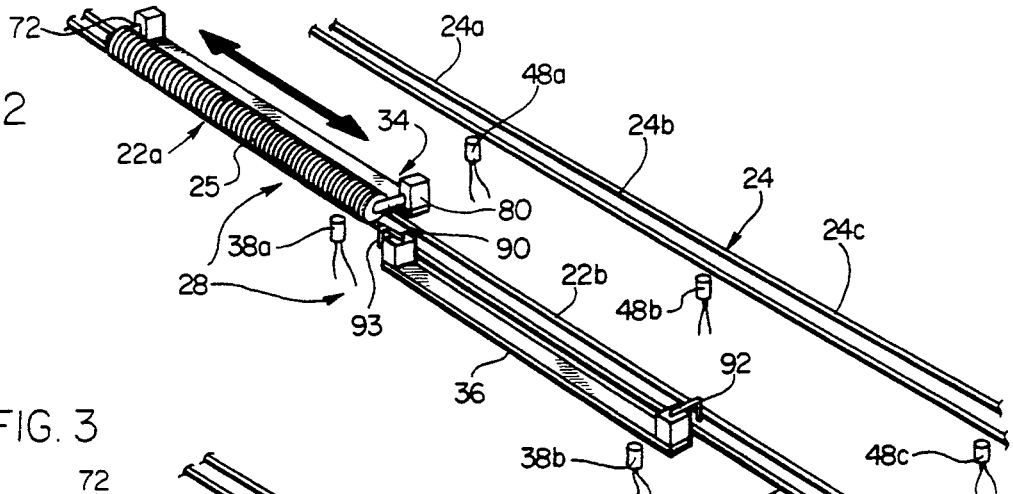
FIG. 2 is a diagrammatic representation Of a first portion of infeed lanes associated with the apparatus of the invention.
Figure 3:
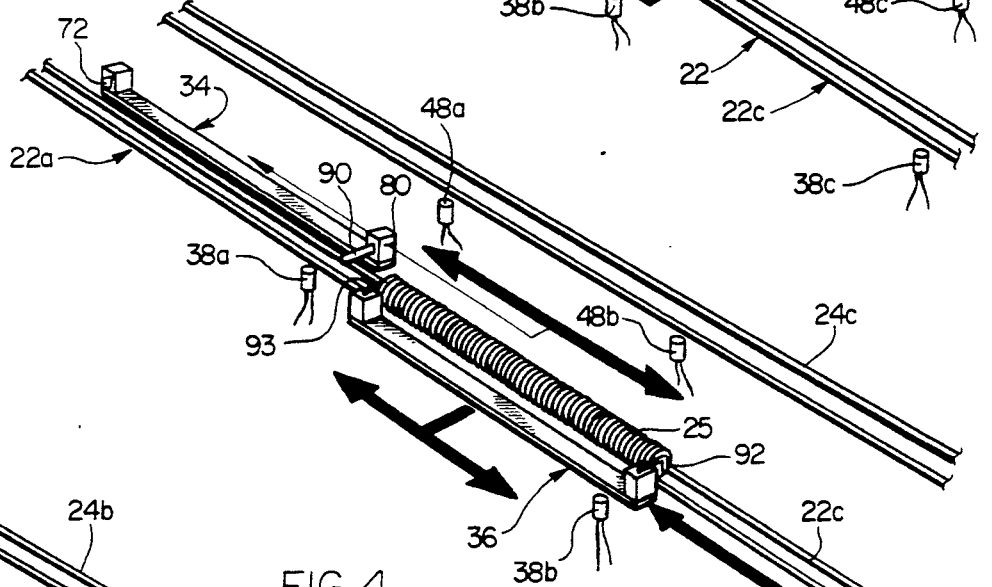
FIG. 3 is a diagrammatic representation showing a second stage or portion of the infeed lanes.
Figure 4:
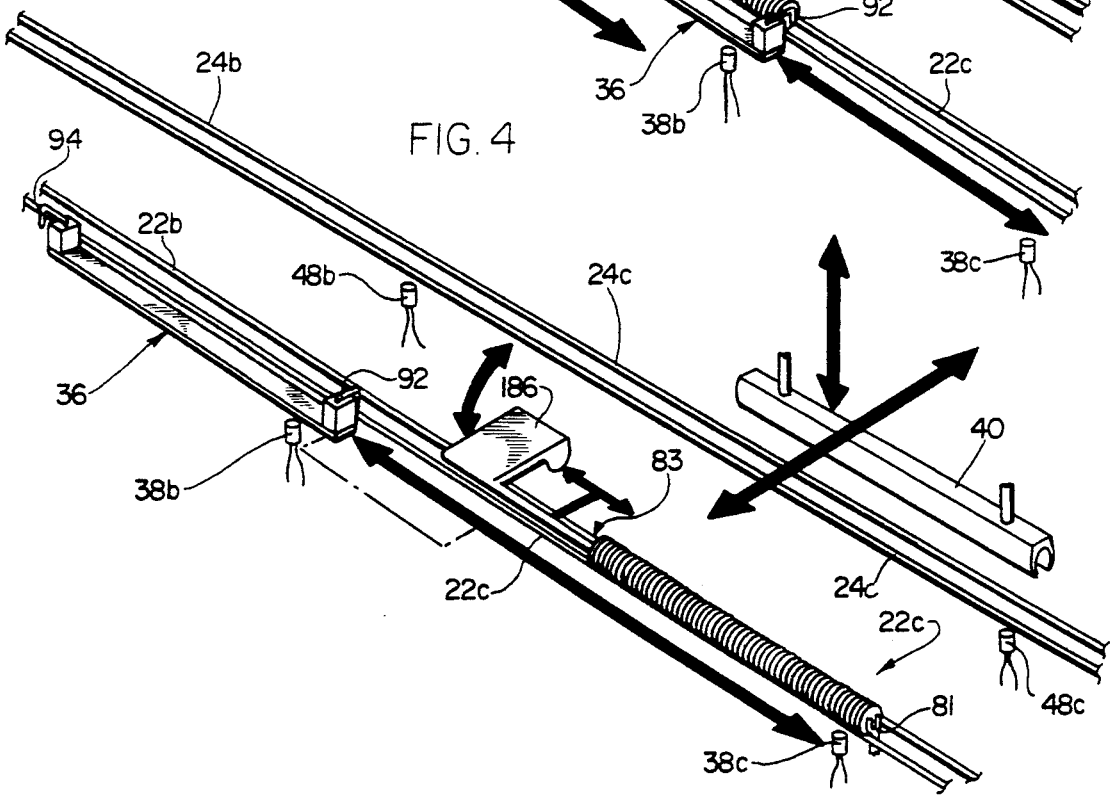
FIG. 4 is a diagrammatic representation of a third stage of the infeed lanes.

Referring initially to the portion of the apparatus illustrated in FIG. 1A and also to the diagrammatic views of FIGS. 2-4, a plurality of generally parallel elongate lanes 22, 24 and 26 are provided for simultaneously handling articles such as can ends 25. In the illustrated embodiment three such lanes have been shown, it being understood that fewer or more such lanes may be provided without departing from the invention, so long as more than a single such lane is provided for handling the articles to be ultimately delivered to a packaging station 30 which is illustrated in FIG. 1B. In the illustrated embodiment the lane 22 is aligned for delivering the articles to the packaging station 30, while lanes 24 and 26 are offset to one side of lane 22.

These lanes 22, 24 and 26 are capable of receiving a flow of articles such as can ends from a can end press or fabrication machinery. As mentioned hereinabove, such machinery typically produces beverage can ends which consist of dished, rimmed aluminum discs, normally having pull off tabs formed thereupon, at a rate of about six hundred per minute per lane. Accordingly, a substantially continuous flow of the nested can ends may be fed alternatively to any one of the three lanes 22, 24 and 26, so as to accommodate the flow of ends at the above-mentioned rate without any interruption.

Transport means generally designated by reference numeral 28 are provided for linearly advancing the articles along at least the lane 22 toward the packaging station 30. In accordance with the invention, the pick-and-place means is provided and is selectively movable between positions in alignment with each of the lanes 22, 24 and 26 for selectively transferring the articles or can ends from lanes 24 and 26 to the lane 22 aligned with the packaging station 30. Control means 32 is provided for controlling a predetermined sequence of operation of transport means 28 and pick-and-place means 40 so as to provide a substantially continuous supply of articles such as can ends to the packaging station 30. It will be seen in the illustrated embodiment that the transport means 28 are arranged for handling the can ends or other articles 25 in groups, each group containing a predetermined number of linearly aligned and nested articles. In the illustrated embodiment, the transport means 28 provide means for advancing groups 25 of articles respectively along each of the lanes 22, 24 and 26.

In the illustrated embodiment, each of the lanes 22, 24 and 26 are similarly constructed and arranged, whereby when details of lane 22 are described, it will be understood that like components are presented with respect to lanes 24 and 26. Each lane 22, 24, 26, has an inlet segment or portion 22*a*, 24*a*, 26*a* and an outfeed segment or portion 22*c*, 24*c*, 26*c*, each of these segments being of a length at least as great as the length of a group of articles 25 for simultaneously accommodating groups of articles in each said lane segment. In addition, the outfeed segment 22*c* of the first lane 22 is as previously described, aligned with and thereby forms an inlet to the packaging station 30. The pick-and-place means 40 are operative to transfer groups of articles from the outfeed segments 24*c*, 26*c* of the other lanes to the outfeed segment 22*c* of the first lane 22. In addition to the inlet and outlet or outfeed segments just described, each of the lanes has an intermediate lane segment 22*b*, 24*b*, 26*b* which is between the respective inlet and outfeed segments and is also of a similar length; that is, for accommodating another of the groups 25 of articles. Accordingly, it will be seen that in the illustrated embodiment, as many as ten separate groups of articles such as the group 25 may be accommodated by the three lanes at any given time. This is the maximum capacity of the illustrated embodiment. It will be understood, however, that fewer or more such lanes, as well as fewer or more such lane segments may be provided without departing from the invention.

As illustrated in FIGS. 2-4 with respect to the lane 22, the transport means 28 include a first carriage means 34 associated with each of the lanes for delivering a group of articles from inlet lane segment 22*a*, for example, to the corresponding intermediate lane segment 22*b*, for depositing the group of articles at the intermediate lane segment and for thereupon returning to the inlet lane segment to receive a second group of articles for transport to the intermediate lane segment 22*b*. This operation is diagrammatically illustrated in FIGS. 2 and 3.

Similarly, the transport means 28 also include a second carriage or carriage means associated with the intermediate lane segment of each of the lanes. One such second carriage means 36 is illustrated in FIGS. 2-4 in connection with lane 22. This second carriage means 36 is operative for engaging a group of articles 25 in the intermediate lane segment 22*b* for advancing this group of articles to its corresponding outfeed lane segment 22*c*, for example, depositing the group of articles in the outfeed lane segment and for returning to the intermediate lane segment to receive a further group of articles for transport to the outfeed lane segment.

Figure 10A:
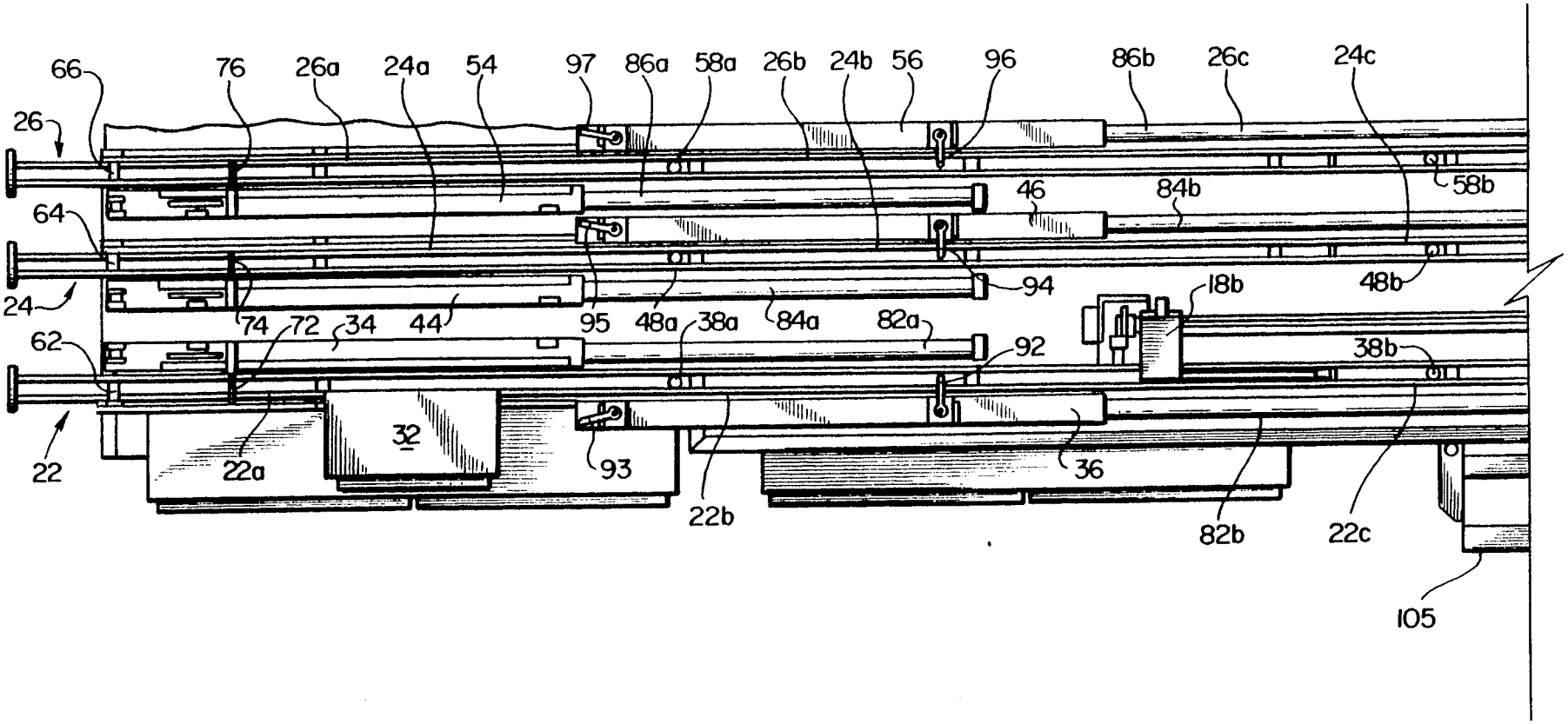
FIGS. 10A and 10B, taken together, form a top plan view of the apparatus of FIG. 1.

Substantially identical first and second carriage means associated with lanes 24 and 26 are indicated in FIGS. 1A and 10A by reference numerals 44, 46 and 54, 56 respectively. While these elements are substantially identical in configuration, their placement has been varied to one or the other side of their respective lanes in order to accommodate the same in a relatively closely side-by-side arrangement of the lanes as illustrated in FIGS. 1A and 10A.

In the illustrated embodiment, each of the lanes 22, 24 and 26 also has associated with its inlet or infeed end, a counting station including article counting means 62, 64, 66 and separating means 72, 74, 76, which form a portion of the first carriage means 34, 44, 54 of the transport means 28. The separating means operate to engage and separate the groups of counted articles from the incoming stream as a group of the desired number is counted by the associated counting means.

Referring to FIGS. 2–4, sensing means 38*a*, 38*b*, 38*c*, 48*a*, 48*b*, 48*c* which may take the form of photo-optic sensors or proximity-type sensors are provided for developing control signals corresponding to filled ones and empty ones of the respective lane segments. The control means 32 are responsive to these control signals for controlling the transport means 28 to advance the individual groups of articles along the respective lanes in order to fill empty ones of the lane segments and generally advance the articles toward the end or outfeed segments of each of the lanes, and ultimately to the outfeed segment 22*c* which also forms an inlet or infeed to the packaging station 30.

In this regard, the control means 32 is further responsive to these control signals developed with respect to the filled or empty condition of the respective outfeed lanes 22*c*, 24*c* and 26*c* for operating the pick-and-place means 40 to retrieve a group of articles from whichever one of outfeed lanes 24*c* or 26*c* is filled at any given time, assuming that the pick-and-place device is presently in an unfilled or empty condition. The control signal indicating the empty condition of outfeed lane 22*c* causes the control means to operate the pick-and-place device to deliver a group of articles which it has previously retrieved to this outfeed segment 22*c* in the event that there is not a group of articles presently available in the immediately preceding lane segment 22*b* for delivery to the outfeed segment 22*c*.

In this manner, a substantially continuous supply of groups of articles is fed to outfeed lane segment 22*c*, which forms the inlet to the packaging station 30. Representative ones of the lane sensors 38*a*, 38*b*, 38*c* and 48*a*, 48*b*, 48*c* have been illustrated with respect to the segments of lane 22 and 24 in diagrammatic form in FIGS. 2 and 3. It will be understood that similar such sensors (not shown) are associated with each of the lane segments of the other lane 26 as well. However, all of the sensors have not been shown in the other illustrations to facilitate clarity of the illustrations and avoid undue cluttering thereof.

In the illustrated embodiment an end support member 80 of the first carriage means 22*a* is movable along the carriage as illustrated generally in FIG. 3 from a front end to a back end thereof to provide a continuous support for the front end of a group of ends 25, being introduced thereto from the inlet and counting means 62 associated with that lane. The separating means is a knife-like blade 72, (74, 76) which may be extended and retracted relative to an end part of carriage 34 to separate a group 25 from the incoming stream when the desired count is reached at the counting means 62.

Figure 18A:
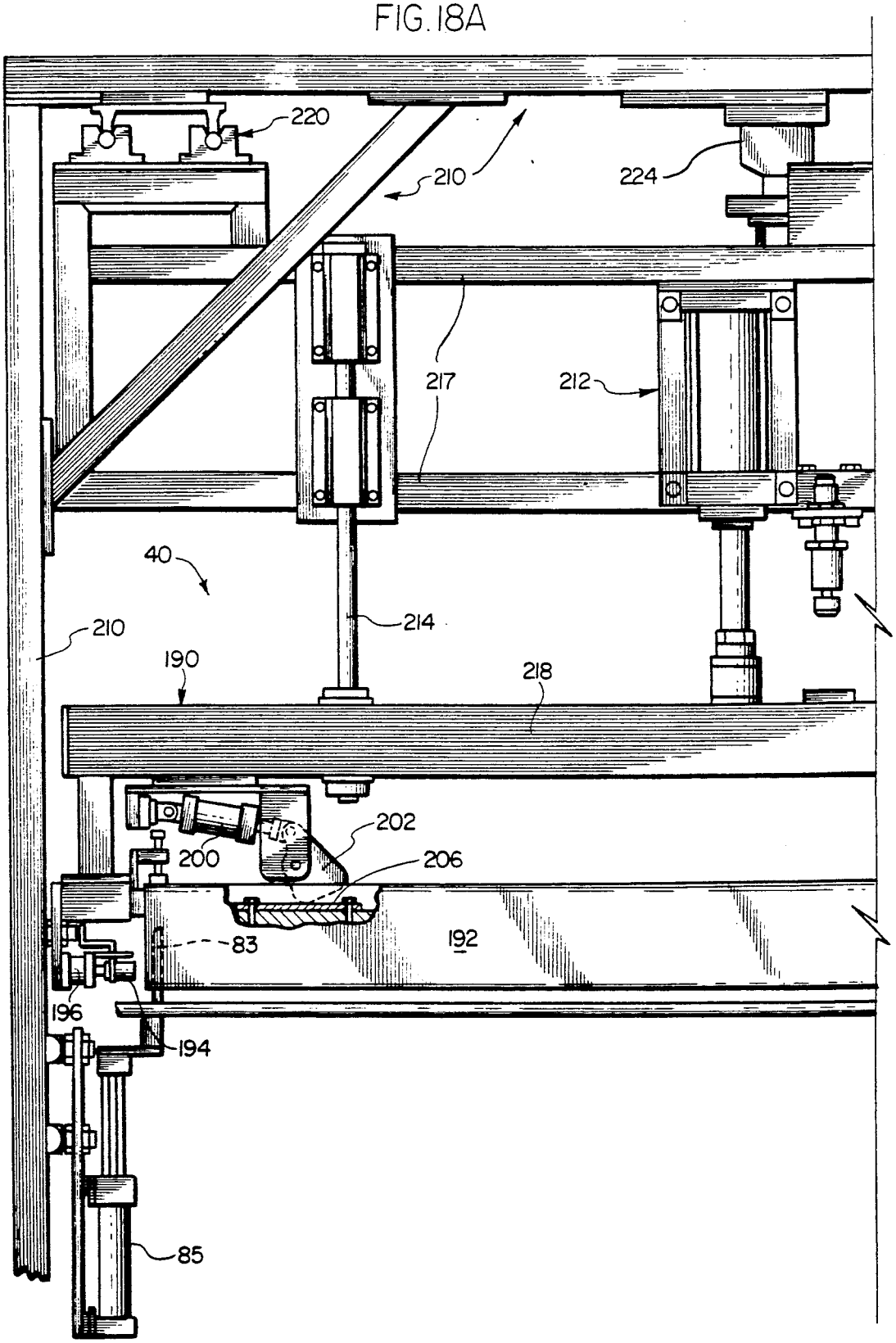
FIGS. 18A and 18B, taken together form a side elevational view of a pick-and-place device associated with the infeed portion of the apparatus of the invention.
Figure 18B:
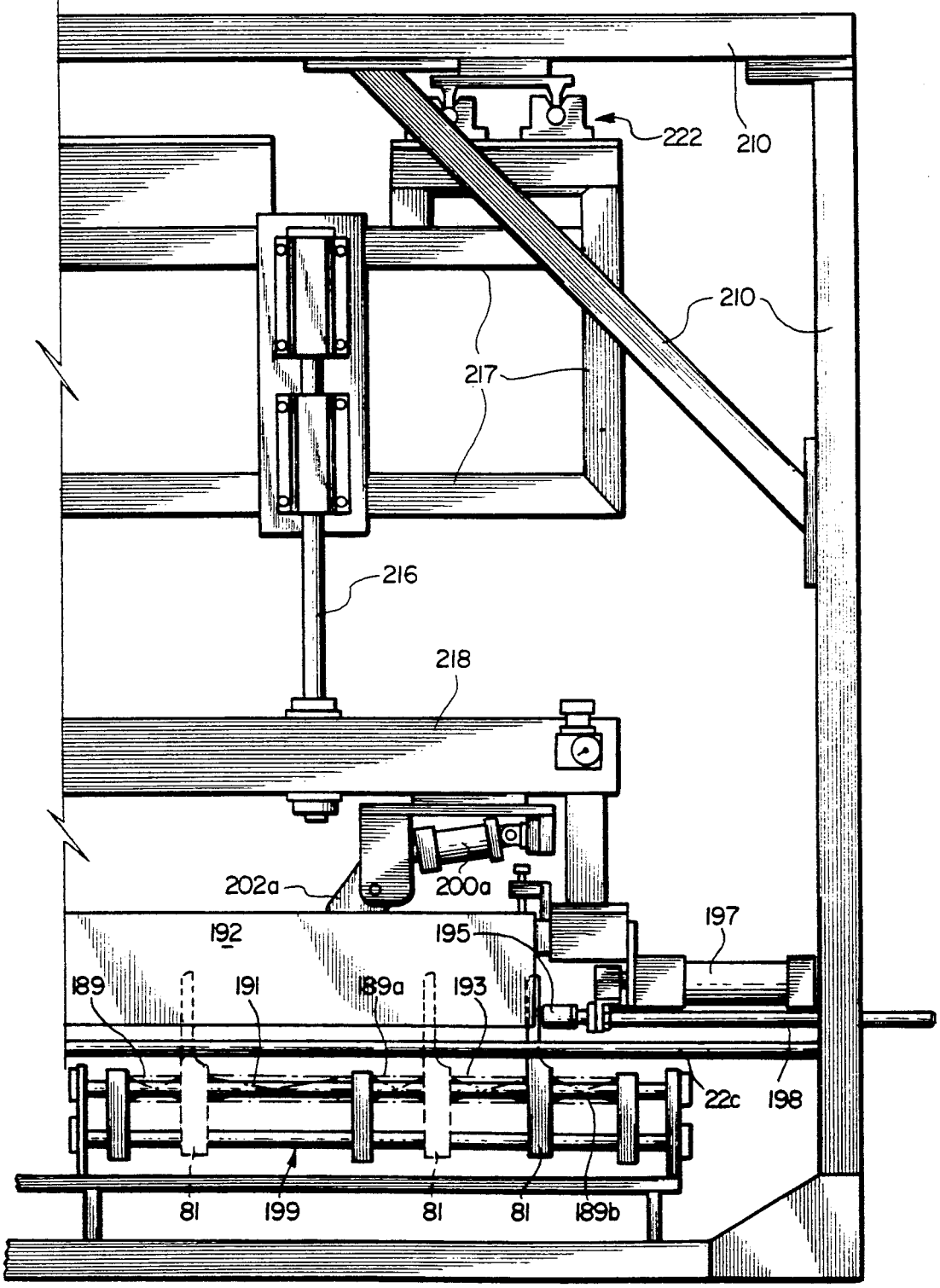

Retractable fork-like end support members such as member 82 illustrated in FIG. 4 are provided at either end of the outfeed lane 22*c*. A fixed fork-like end stop 83 is provided with respect to the terminal end of each of lane segments 24*c* and 26*c* and a similar extendable fork-like support is provided for the opposite ends of each of these lane segments. The fork-like support members 81 and 83 are also illustrated in FIG. 18 in connection with the operation of the pick-and-place device 40.

It will be appreciated that in operation each of the carriage assemblies is mounted to a corresponding elongate cylinder which extends over the lengths of two adjacent ones of the lane segments between which the associated carriage assembly is movable to deliver the group of articles 25 from one lane segment to the next as described hereinabove. Such cylinders are illustrated as indicated at reference numerals 82*a*, 82*b*, 84*a*, 84*b* and 86*a*, 86*b* in FIGS. 1A and 10A. Thus cylinder 82*a* extends over the length of lane segments 22*a* and 22*b* to permit the associated carriage 34 to deliver a stack of ends 25 between these two lane segments.

Each of the carriage means 34, 44, 54, and 36, 46, 56 are provided with respective extendable and retractable end support members for supporting the group or stack of can ends 25 when the same is to be transported by the carriage means, and for otherwise retracting to permit transfer of a group of ends 25 between carriages, as for example, between carriages 34 and 36 as illustrated in FIGS. 2 and 3. Such retractable end support means include the separating blade 72 previously described, a similar blade-like support member 90 is provided on the end support structure 80 with respect to the carriage 34. The blade-like support member 90 will move with the stack of ends as it is being developed and also during transport to the position shown in FIG. 2. A pair of pivotally mounted support arms or fingers 92, 93 of carriage 36 have their pivoting motion coordinated with the movement of the carriage 34 and introduction to carriage 36 of the group of articles or can ends 25 from carriage 34. The relative position of support 92 is adjustable to handle variances in the length of a stick of ends. Hence, the trailing end support member 93 is shown retracted in FIG. 2 to permit introduction of the group of ends 25. However, this support is shown engaging the ends when the transfer has been completed as shown in FIG. 3. Similar extendable and retractable support members 94, 95 and 96, 97 are provided for each of the other carriages 46 and 56 and are illustrated in FIGS. 1A and 10A.

Figure 5:
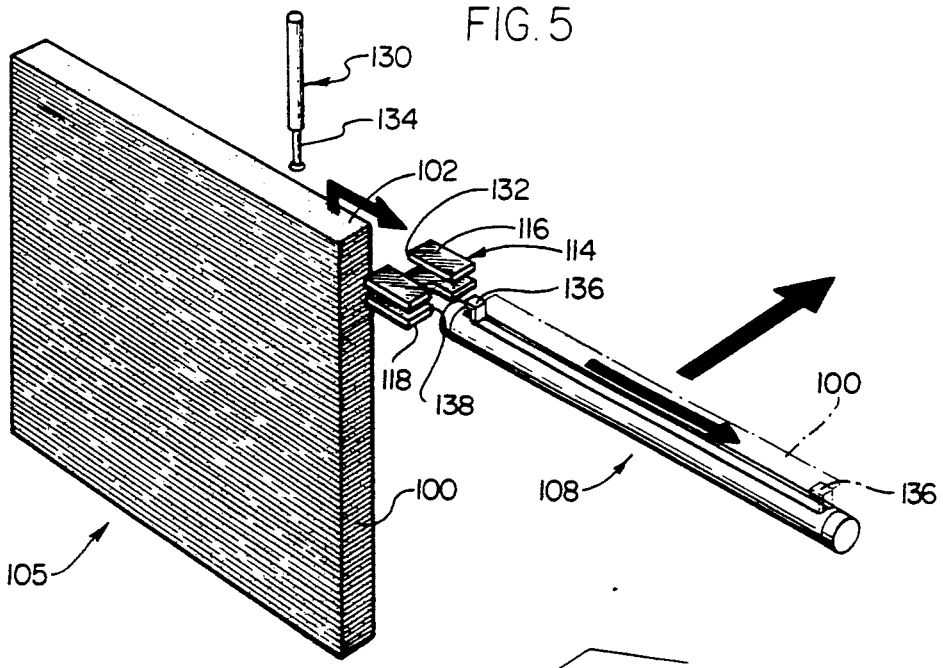
FIG. 5 is a diagrammatic representation of a portion of the bagger apparatus of the invention.
Figure 6:
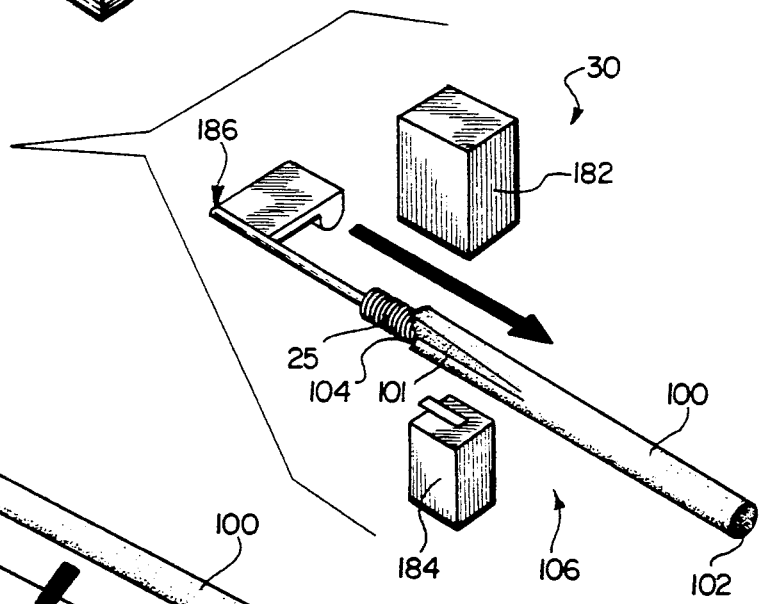
FIG. 6 is a diagrammatic representation of a further portion of the bagger apparatus of the invention.
Figure 7:
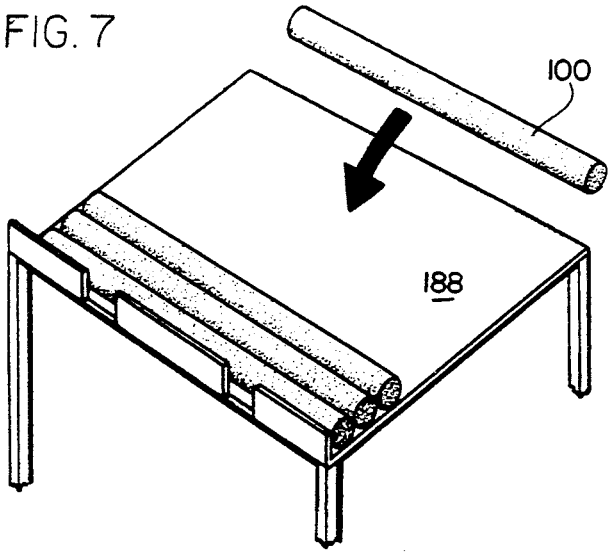
FIG. 7 is a diagrammatic representation of a final or outlet portion of the bagger apparatus of the invention.
Figure 8A:
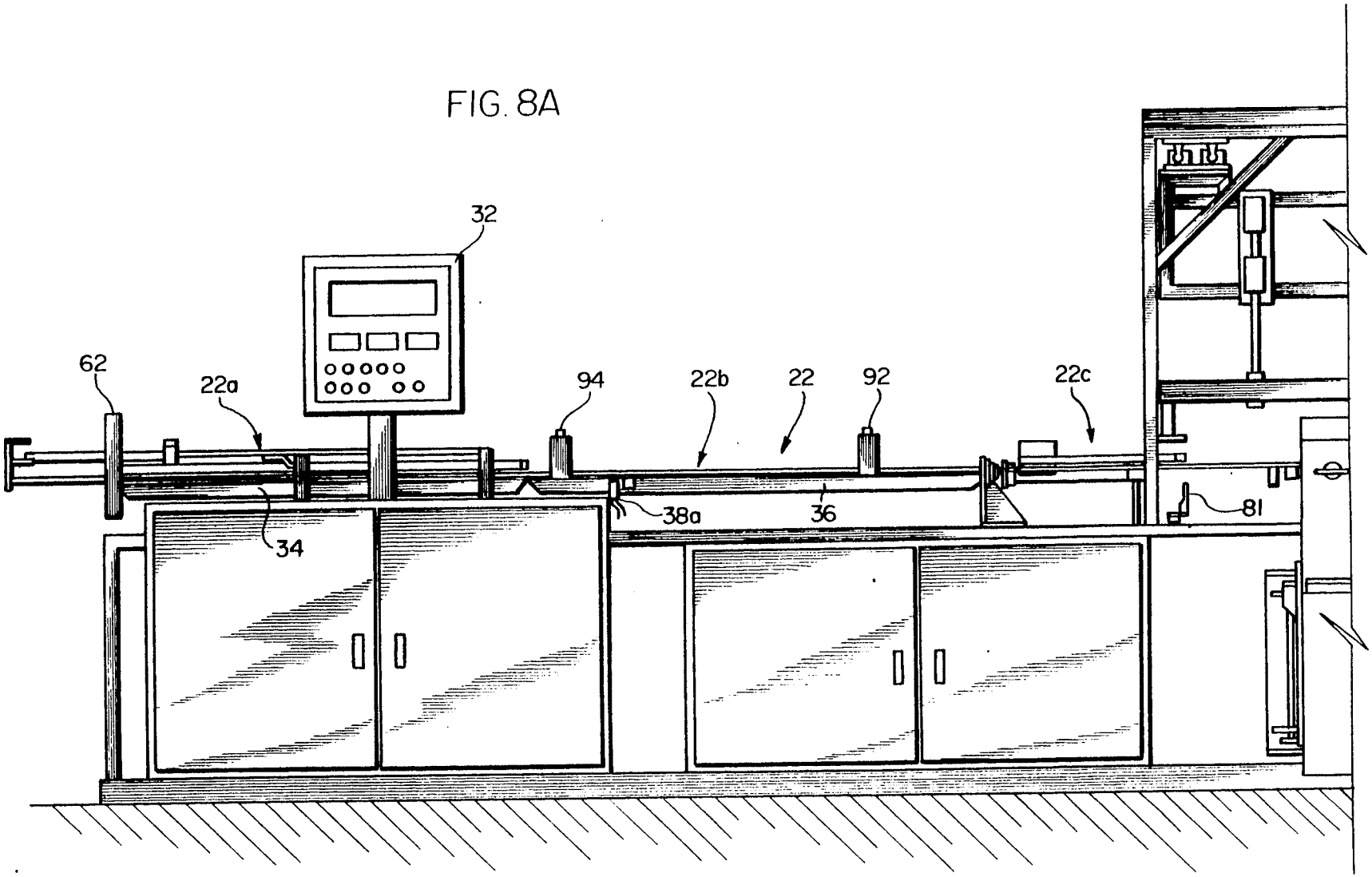
FIGS. 8A and 8B taken together form a side elevational view of the apparatus of FIG. 1.
Figure 8B:
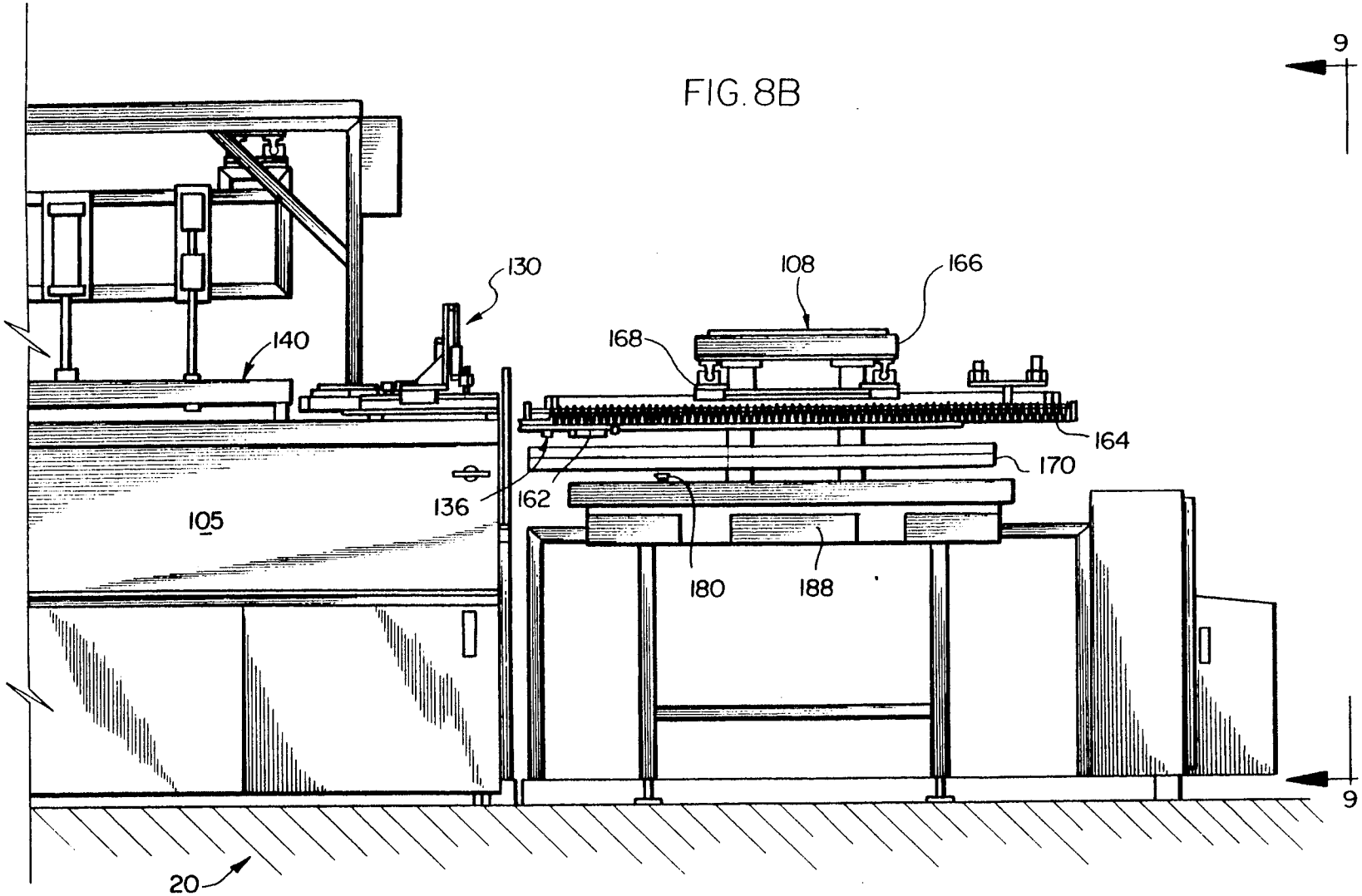
Figure 9:
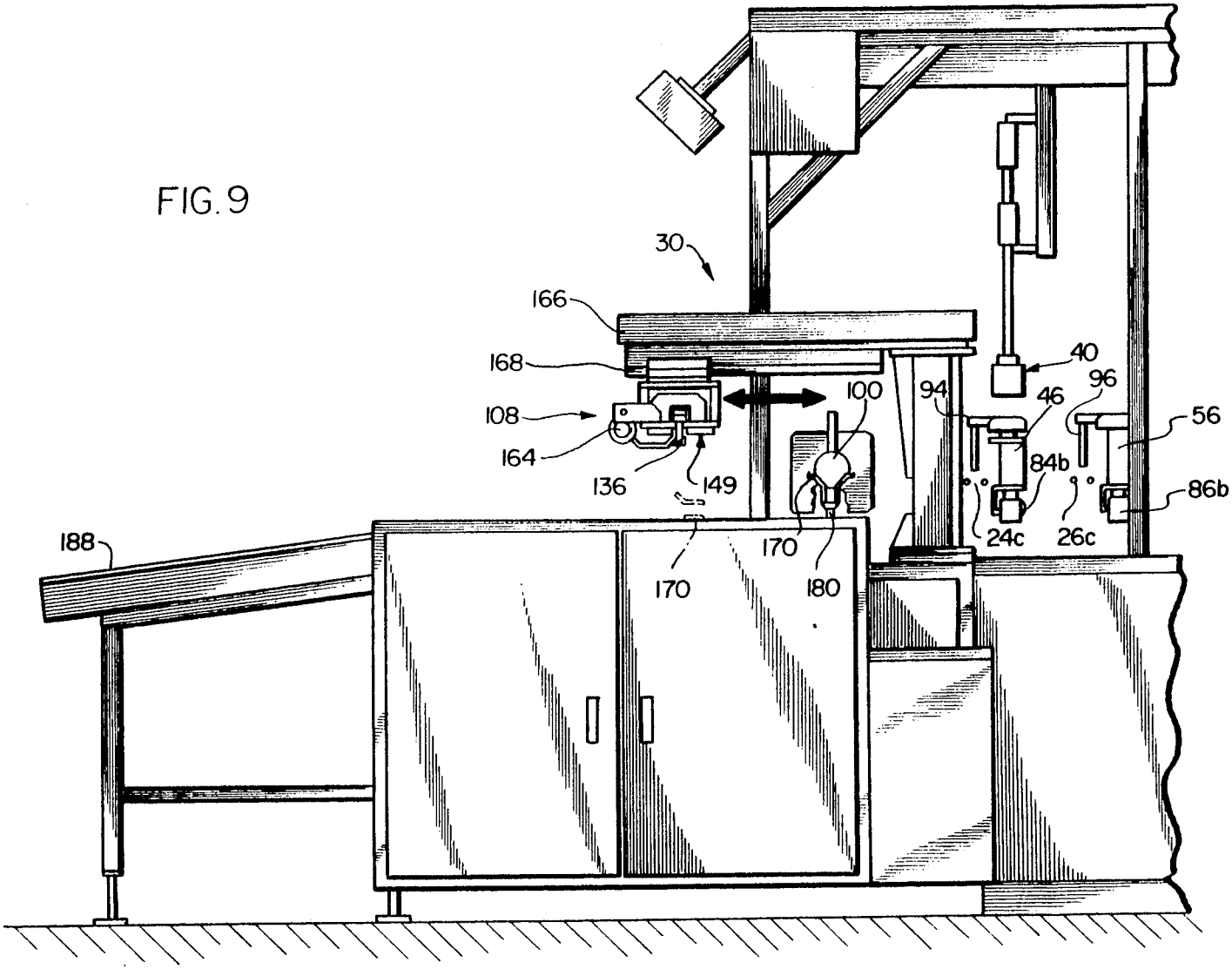
FIG. 9 is an end view of the apparatus of the invention taken generally in the plane of the line 9—9 of FIG. 8.

In accordance with another aspect of the invention, and referring initially to FIGS. 5–7 there is shown somewhat diagrammatically an article packaging apparatus for packaging a group of articles such as the group 25 of can ends of a predetermined number disposed in a nested condition in an elongate bag-like package. Preferably, the elongate bag-like package utilized, which is shown somewhat diagrammatically at reference numeral 100 in FIGS. 6 and 7, has side gussets 101, a folded over and adhesively-secured closed end 102, and an opposite open end 104. Upon introduction of the articles therein folding and sealing of the open end 104 take place such that it assumes a state similar to that of the closed end 102. The article packaging apparatus generally includes a magazine portion 105 illustrated in FIG. 5 and a bag filling and closing portion 106 which is shown diagrammatically in FIG. 6. An intermediate bag transport portion or assembly 108 (FIG. 5) is arranged to remove bags from the supply carried in the magazine 105 and introduced bags to be filled at the filling station 30 previously described, where the bag filling apparatus or assembly 106 is located.

Figure 11:
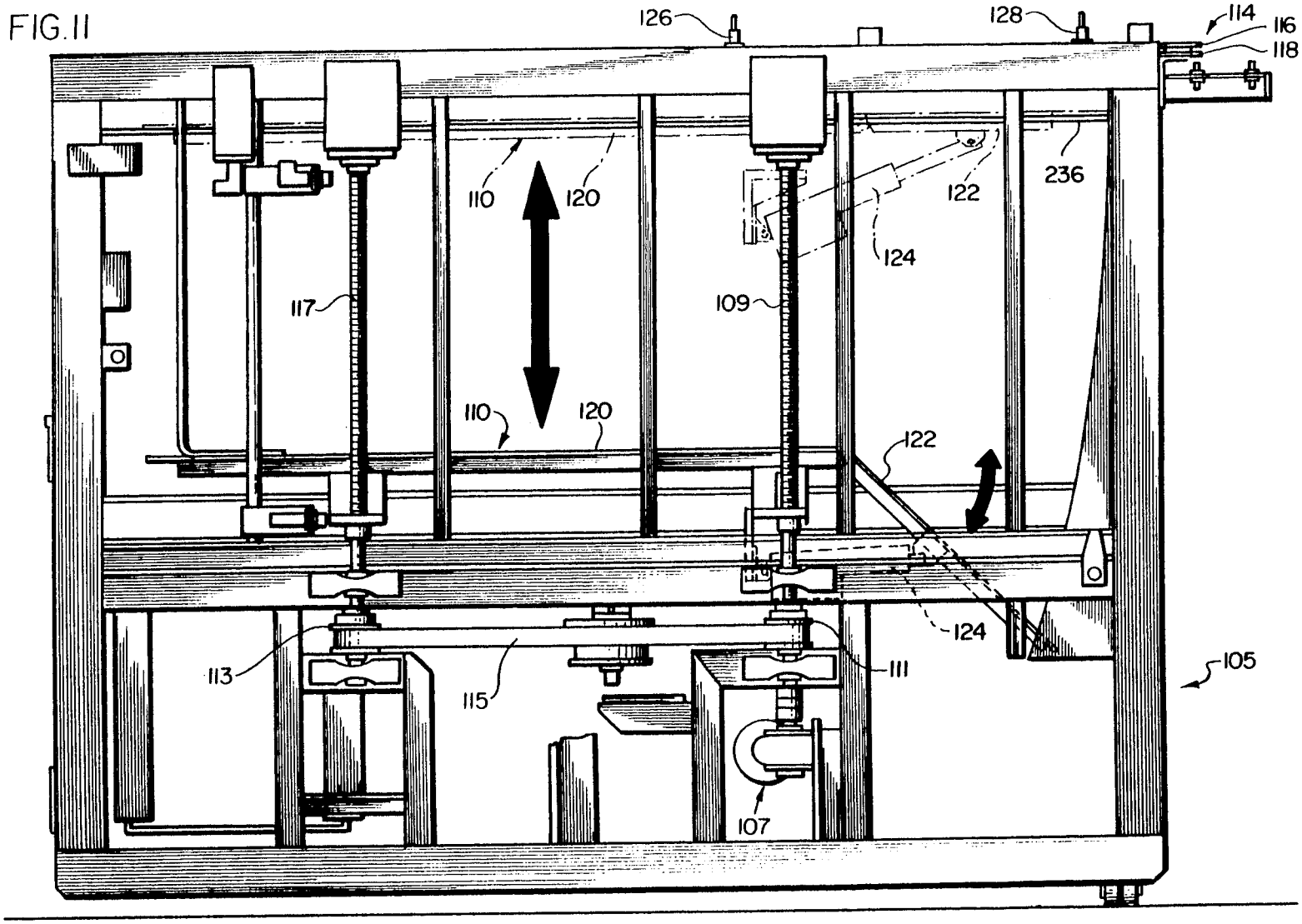
FIG. 11 is a side elevation of a magazine portion of the bagging assembly of the invention.

With reference also to FIG. 11, wherein further details of the magazine assembly 105 are illustrated, it will be seen that the magazine 105 includes an articulated support means or assembly 110 for supporting the bags or packages 100 in a collapsed, stacked condition. As indicated in FIG. 6, the bags 100 are generally provided with side gussets 101 to permit opening thereof to receive the can ends 25. Hence the gussets 101 are collapsible in order to stack the bags in a compact arrangement within the magazine 105 as indicated diagrammatically in FIG. 5. Elevating means in the form of a motor 107, which drives a first screw 109 and by way of pulleys 111, 113, and belt 115 drives a second screw 117, is operative for elevating and retracting the support means or assembly 110 relative to an outlet or outfeed portion 114 of the magazine which is located at an upper end portion thereof. This outlet or outfeed generally includes a pair of guide plates 116, 118 through which a topmost one of the bags 100 may be drawn by its closed end 102.

The articulated support assembly 110 includes a first or main support portion 120 which supports a major portion of the packages or bags 100 and a secondary support or portion 122 which is hingedly or pivotally coupled with the main support portion in an articulated fashion. An articulation drive means which, in the illustrated embodiment, takes the form of a piston and cylinder assembly 124 is operatively coupled for controllably varying the angle of the secondary support portion 122 relative to the main support portion 120.

It will be noted that the folded over and adhesively or otherwise secured closed ends 102 of the bags 100 are by their nature of substantially double thickness compared with the remaining portions of the bags. Hence, when the bags are collapsed and stacked in the magazine 105 as schematically illustrated in FIG. 5, these thicker end portions 102 will tend to impart a considerably greater height to the stack of bags as a whole at the closed end, than that of the remaining portions of the bags. However, it will also be recognized that this height differential will gradually decrease as the bags are drawn off through the outfeed 114 and the stack becomes gradually depleted. The articulated support assembly permits raising and lowering the secondary support portion 122 as necessary to hold the closed end part of at least the topmost one of the bags at a predetermined angle relative to the remaining portion thereof. In the illustrated embodiment, this angle is such that the topmost bag remains in a substantially flat and level condition, that is, there is no angle between the end portion 102 and the remaining portion of at least the topmost one of the bags in the magazine 105. This facilitates withdrawal of the end portion 102 through the guide plates 116, 118 of outfeed 114 and assures that the remainder of the topmost bag will follow smoothly through these guide plates.

In order to control operation of the piston and cylinder 124, further sensing means 126, 128 are provided near a top end of the magazine 105 for sensing the condition of the topmost bag relative to a level condition. In this regard it will be seen that sensor 126 is positioned generally for detecting the main body portion of the topmost bag, whereas sensor 128 is positioned for detecting the closed end portion 102 thereof. These sensors may be photo-optic sensors or any other suitable type of sensor without departing from the invention. These sensors 126 and 128 produce corresponding control signals and the control means 32 is responsive to these signals for adjusting the articulation control means or piston and cylinder 124 for varying the relative angle of the secondary support means or member 122 so as to achieve a substantially level condition of the topmost bag or package.

The package transport means 108 is provided with a topmost bag 100 from magazine 105 by means of a movable vacuum-type bag engagement assembly or means 130. The bag engagement assembly 130 engages the closed end 102 of the topmost bag and draws at least a portion of the closed end 102 through the outfeed 114 and in particular through the guide plates 116, 118 thereof. It will be noted that the topmost guide plate 116 is provided with a recess or cutout portion or slot 132 to permit a vacuum head portion 134 of the vacuum engagement means to extend thereinto a sufficient amount to feed a part of the end 102 partially through the plates. Cooperatively, a movable gripping means or member 136 is positioned for gripping a part of the closed end 102 drawn through the outfeed by the vacuum means 130 and for drawing the same onto the transport means 108. The bottom plate 118 of the outfeed is provided with a similar, oppositely facing and overlapping cutout or opening 138 for permitting a portion of the gripping means to extend thereinto to positively engage the closed end part 102 of the bag 100, which has been partially advanced through the outfeed 114 by the vacuum means 130.

Figure 13:
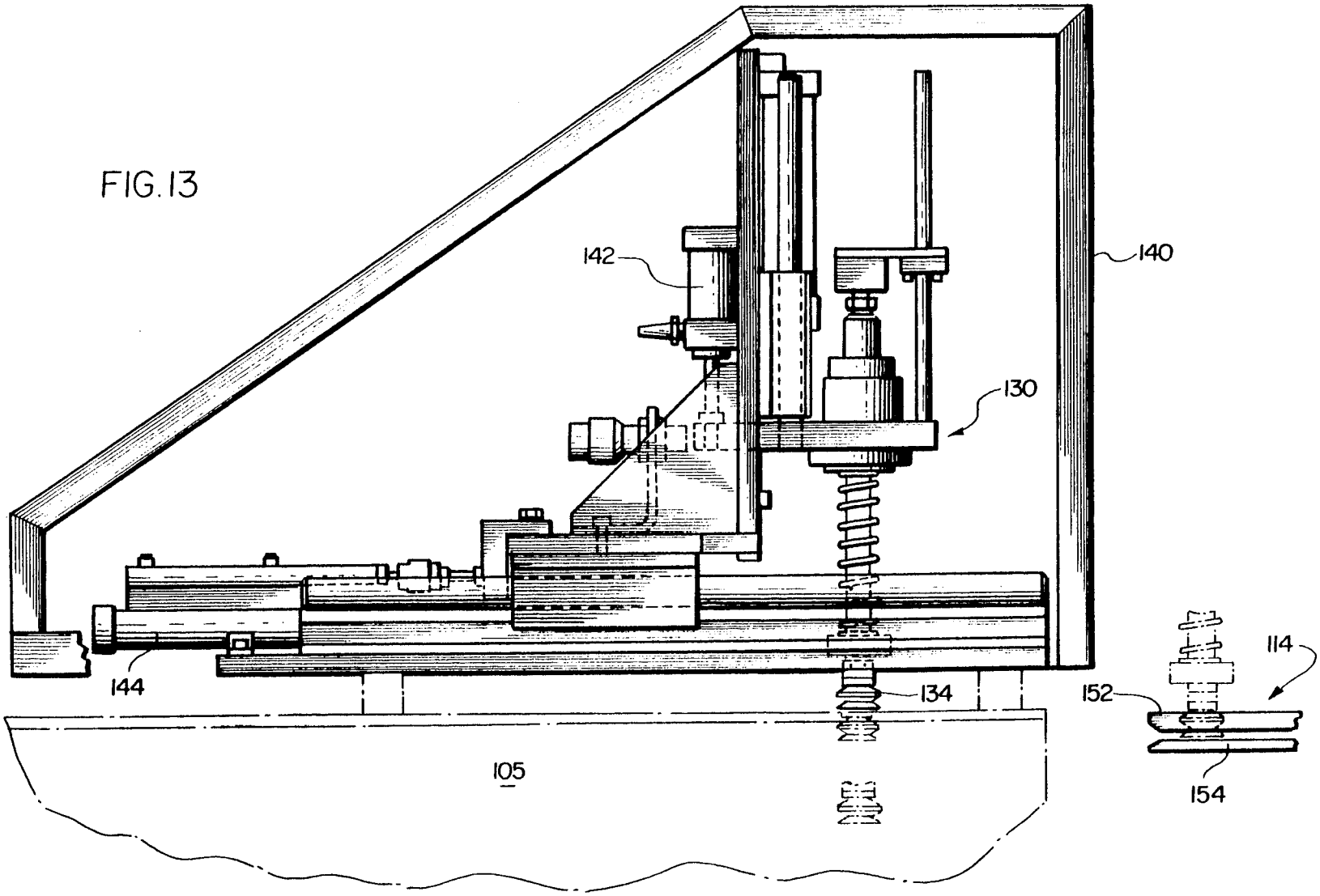
FIG. 13 is an enlarged side elevational view showing a vacuum cup arrangement for removing an end portion of a topmost bag or package from the magazine of FIGS. 11 and 12.

Further details of the movable vacuum means 130 are illustrated in FIG. 13. It will be seen that the vacuum means 130 is mounted for vertical and horizontal movement relative to a frame 140 with the vertical motion being driven by a piston and cylinder assembly 142 and the horizontal motion being driven by an elongate cylinder 144. This permits the relative vertical and horizontal movement of the vacuum head or suction cup 134 thereof generally between the position shown in solid line in FIG. 13 and the various positions shown in broken line, for respectively descending to retrieve a bag from the magazine 105 and drawing the closed end 102 of the bag thus retrieved to and partially through the outlet 114 to be engaged by the gripping means 136.

Figure 14:
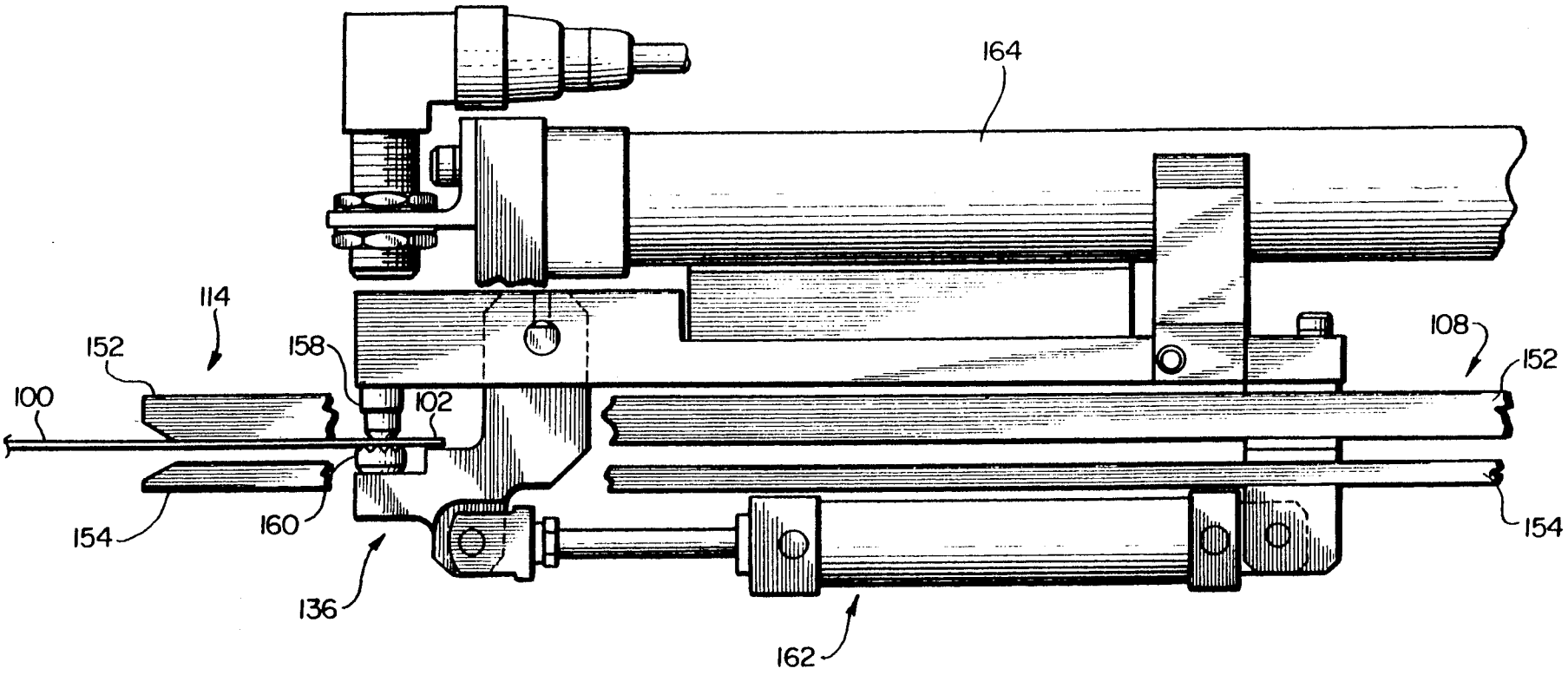
FIG. 14 is an enlarged partial side elevational view of a gripping and transport member for transporting a bag from the magazine to a bagging station of the apparatus of the invention.
Figure 15:
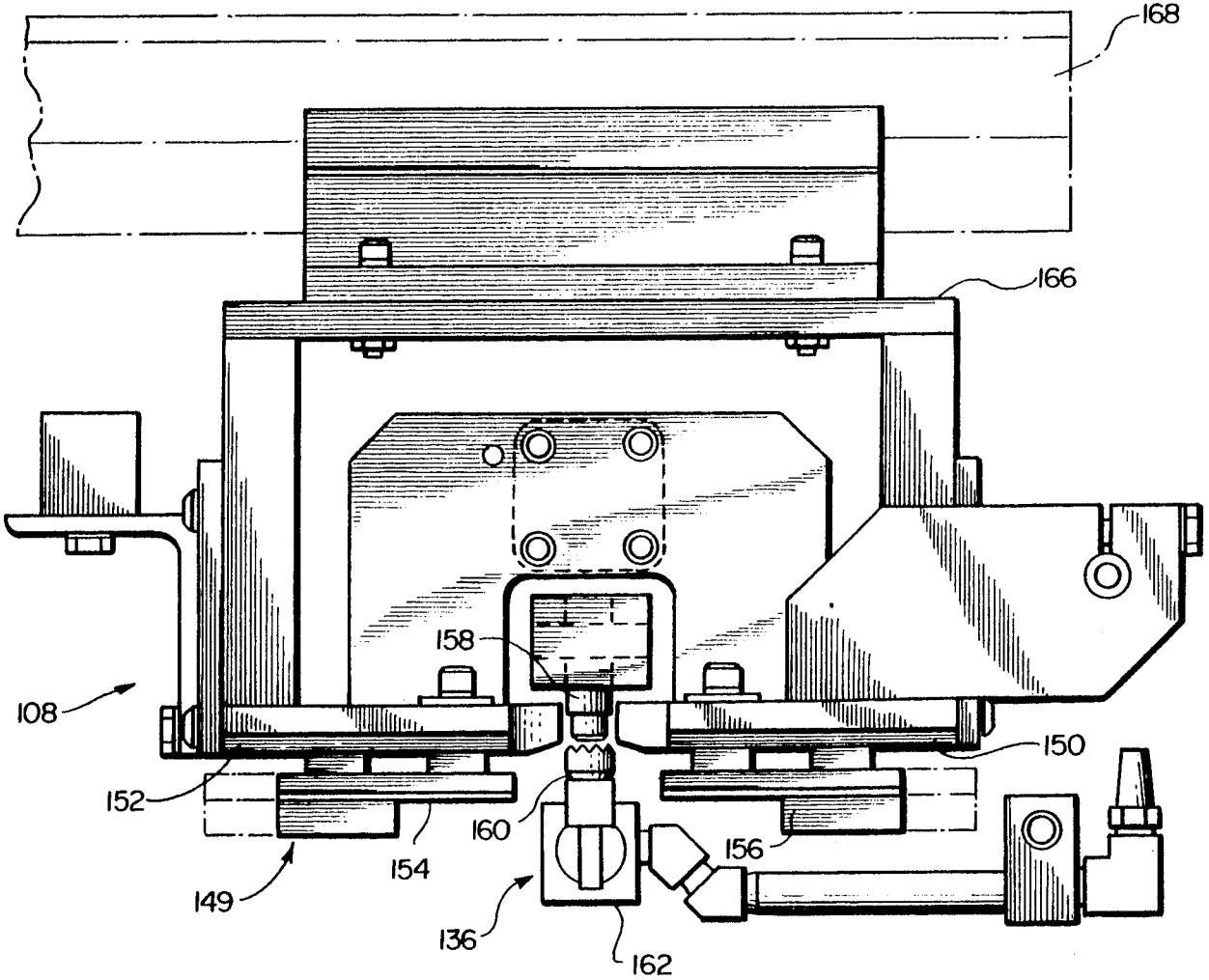
FIG. 15 is an end view of FIG. 14.

Referring now to FIGS. 14 and 15, it will be seen that the bag transport means 108 includes an elongate tray-like assembly 149 having a pair of closely spaced top plate members 150, 152 and a pair of closely spaced and relatively inwardly and outwardly movable bottom plate-like members 154 and 156. The latter plates 154 and 156 are spaced somewhat below the top plates 150 and 152 to provide space for receiving a bag therebetween. The lateral gap or spacing between the respective plates allows room for the gripping means or member 136 to travel therebetween so as to draw a bag from the outfeed 114 into the tray 149 formed by the respective plates 150, 152, 154 and 156.

Figure 10B:
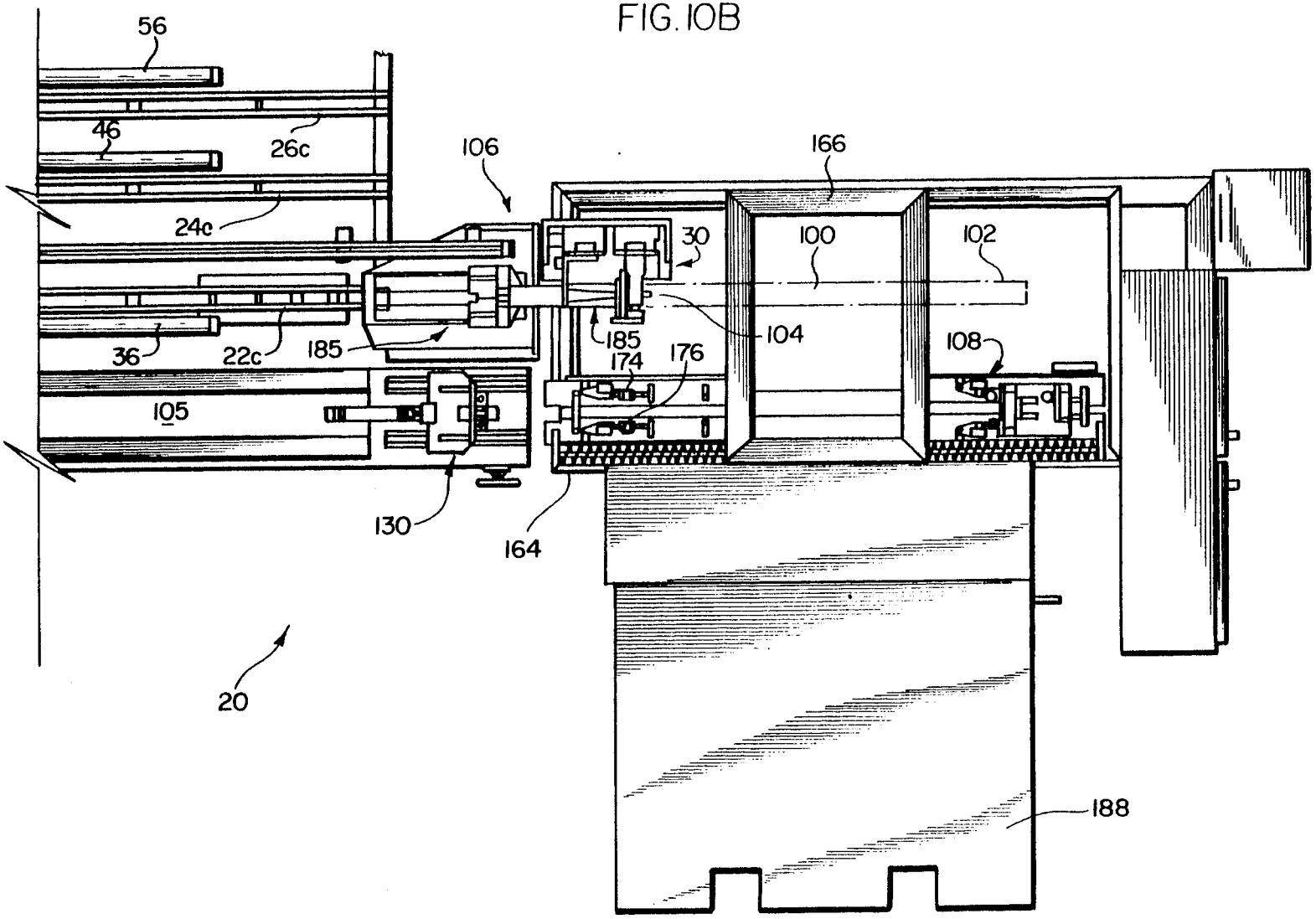

The gripping means 136 consists of an upper fixed jaw member 158 and a lower, relatively movable jaw member 160, which is also preferable provided with a number of teeth or serrations for positively engaging an end part 102 of a bag 100 therebetween. The lower jaw 160 is hingedly articulated in a jawlike fashion to open and close relative to fixed upper jaw 158 and is driven by a suitable piston and cylinder assembly 162 for opening and closing and thereby grippingly engaging and releasing a bag end 102. The entire gripping assembly 136 is also mounted to an elongate cylinder 164 which is arranged for drawing the gripping jaws 158, 160 the entire length of the tray 149 to draw the entire length of a bag 100 into the tray for transport from the magazine 105 to the bagging station 30. To this end, the transport assembly 108 including the tray-like assembly 149 is carried on a track 168 mounted to a frame 166 for horizontal movement between an area in alignment with the magazine outlet 114 to an area in alignment with the bagging station 30 as best viewed in FIG. 17. The lower plates 154 and 156 are moved inwardly and outwardly to permit release of the bag at the bagging station 30 by respective control pistons and cylinders 170, 172 which are shown in FIG. 10B. As illustrated, the entire gripping assembly 136 is also mounted to the frame 166 such that it moves in unison with the transport assembly 108. This facilitates alignment of gripping assembly 138 with the tray 149. However, other arrangements could be used without departing from the invention.

Figure 16:
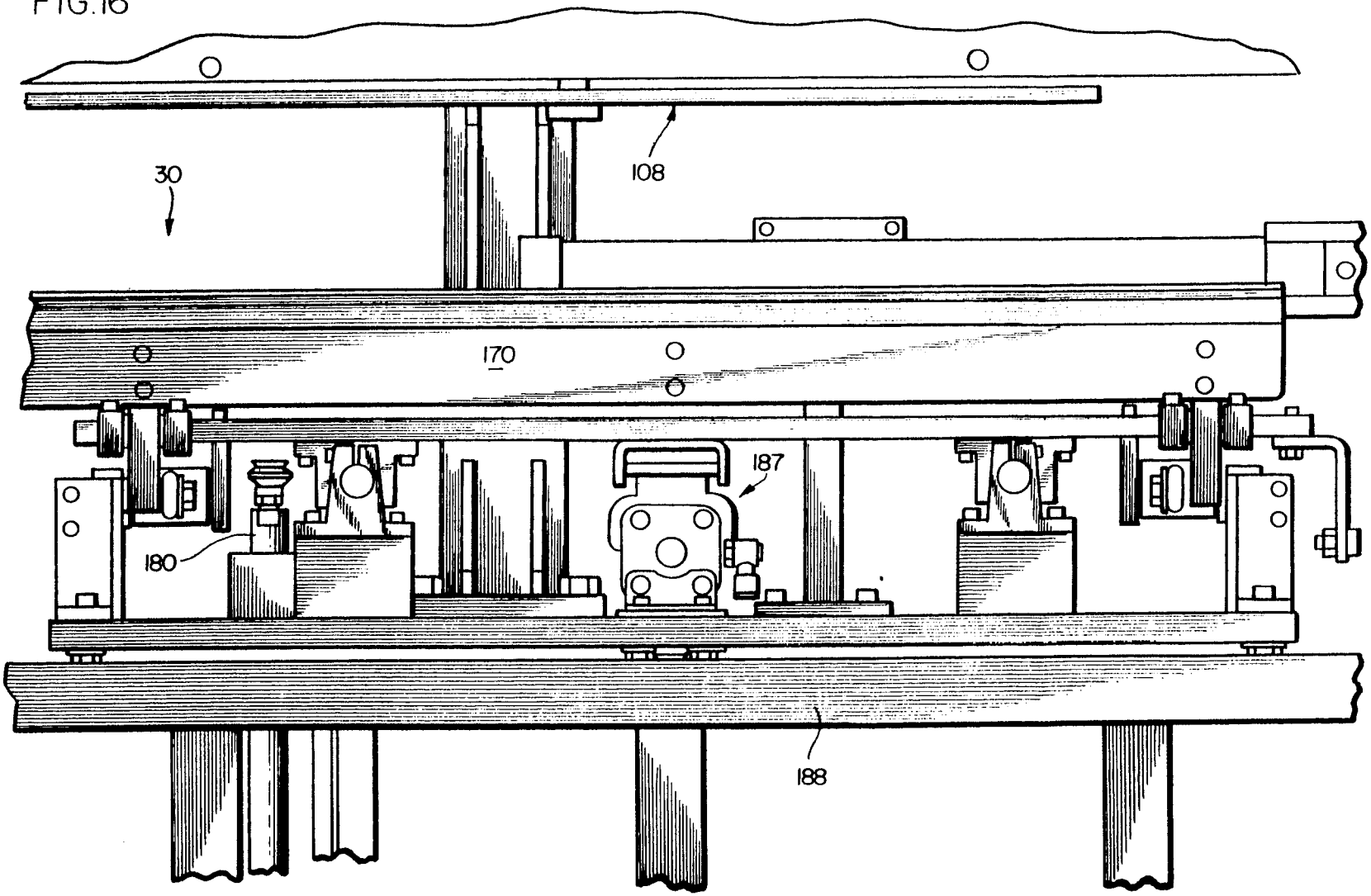
FIG. 16 is a side elevational view of a portion of the bagging station.
Figure 17:
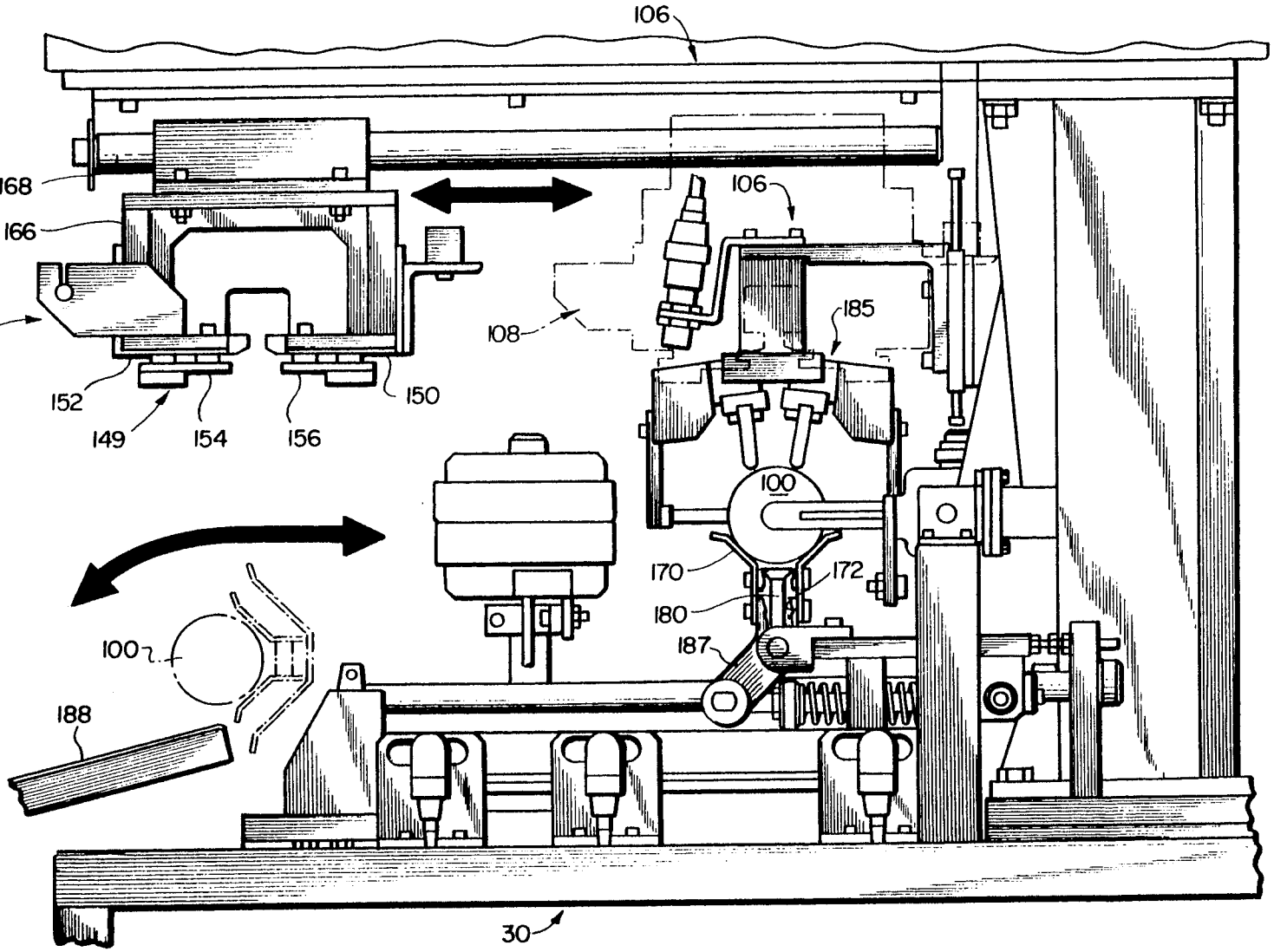
FIG. 17 is an end view of FIG. 16.

At the bagging station 30, FIGS. 16 and 17, the bagging apparatus 106 employs an elongate, generally split V-shaped trough means or assembly 170 which receives and supports a bag from the tray assembly 149 of the transport means which is moved into position thereover along the track 168 for delivering a bag thereto. As the bottom plate members 154 and 156 are spread apart by cylinders 174, 176, the bag 100 is drawn down from the tray 149 by one or more vacuum means or members 180 of similar configuration to the vacuum means 130 and head 134. These vacuum means 180 are selectively extendable and retractable relative to a through central opening 172 defined in the split V trough 170 for engaging a package in the transport means or tray 149 and drawing the same onto the trough 170 to be filled.

The packaging or bagging station includes suitable bag handling means 185 for respectively opening and positioning the open end 104 of a bag for disposition of a group of articles therein, when a group of articles has been moved into alignment with the packaging station by the article transport means 28 associated with the lanes 22, 24 and 26. That is, a group of articles is moved into the lane **22*c* either from other segments of the lane 22 or from the corresponding endmost segments 24*c*, 26*c* of the other lanes by the pick-and-place means or assembly 40**.

The bagging apparatus 106 at the bagging station 30 also includes, as diagrammatically shown in FIG. 6, an end folding or folder apparatus 182 and a taper 184 for respectively folding over and taping shut the open end 104 of the bag 100 when the same has been filled with a group of articles 25. In the illustrated embodiment, an elongate push-rod means or assembly 186 is pivotally movable into and out of engagement with the stick of ends or articles 25 disposed in the lane segment **22*c* and is movable therealong for advancing the group of ends 25 through the bagging apparatus and completely into and filling the bag 100 positioned at the bagging station 30**.

Further details of the bagging apparatus 106 and the operation thereof for holding an open end of a bag 100 and filling the same with ends, including operation of the push-rod means 200 and for thereafter folding and taping the open end, are substantially shown and described in the above-mentioned patent to Mojden et al, U.S. Pat. No. 4,537,010 dated Aug. 27, 1985.

Upon filling of a bag 100, the trough means 70 is further movable by a discharge means or linkage 187 horizontally outwardly, and is pivotally rotated thereby for depositing a filled bag 100 onto a roll-out tray or platform or filled-package discharge area 188, where the bags may be collected by manual or mechanized means, as desired. At one stage during movement, an ink jet printer (not shown) may be used to code the bag with identifying indicia. The discharge means 187 is engageable with the trough means 170 for discharging a filled package 100 therefrom into the discharge area 188 and thereafter returning the empty trough means 170 into a position for receiving a further bag 100 to be filled at the bagging station 30.

Apparatus according to claim 12 and further including reserve supply means for holding a quantity of said packages toward a topmost end of said magazine, and control means for coordinating operation of said reserve supply means with said articulate supporting assembly for receiving a quantity of packages from said article supporting assembly as the same is raised relative to said outfeed, to permit said articulated supporting assembly to return to a lowered position to be refilled with a further quantity of packages, while still providing a supply of packages at said outfeed for use at said bagging station, as shown in FIGS. 12, 19, 20 and 21.

Referring now to FIG. 18, the pick-and-place device or assembly 40 is illustrated in further detail. The pick-and-place device is essentially the same as the pick-and-place unit described in our prior copending U.S. application Ser. No. 195,220, filed May 18, 1988 to which reference is invited. The pick-and-place unit 40 includes a gripping portion or means 190 which takes the form of a pair of elongate arcuately shaped arms or jaw-like members 192 which are arranged to generally surroundingly engage a group or stick of articles or can ends 25. An additional pair of oppositely axially inwardly directed pressing means or members 194, 195 are provided for pressing upon opposite axial ends of the group of articles or can ends within the gripping means or portion 190 to securely hold the group tightly axially nested within this gripping means 190. The article pressing means 194, 195 are driven in the axial direction relative to the group of ends by respective air cylinders 196, 197. It will be seen that the air cylinder 197 and its axial article pressing member 195 are arranged for axial adjustment generally axially inwardly and outwardly relative to the gripping means or jaws 190 for accommodating groups of articles such as can ends having an axial length which varies by approximately as much as the axial length of an elongate mounting rod or member 198 which mounts the article pressing means or member 195 relative to its cylinder 197.

Cooperatively, it will also be seen that the end supporting member or fork-like member 81 is also mounted to an assembly 199, which is spring-loaded for providing a resilient end stop for accommodating an incoming group of can ends. Moreover, this assembly 199 also permits an adjustment or change of the relative position of the end fork or end support means 81 by selecting different lengths and positionings of a number of compression springs of various lengths as indicated generally by reference numerals 189, 191 and 193. Hence the fork member or means 81 may be positioned for accommodating varying axial lengths of groups of can ends, as generally indicated in phantom line in FIG. 18B.

The gripping members or jaws 192 are arranged to be opened and closed by the action of a pair of similar assemblies located generally at either end thereof. These assemblies each include a piston and cylinder type drive means or member 200 which is arranged for extending and retracting a cam-like member 202. The cam-like members 202 are arranged for bearing against complementary cam surfaces 206 of the jaw members 192. The jaws 192 are, in turn, pivotally mounted and tension springs (not shown) join the pivotally mounted jaws 192 to normally urge the jaws in a direction for closing. Hence, the cam members 202 may be activated to force the jaws open, overcoming the action of the springs.

The pick-and-place means or assembly is further mounted to a support frame 217 and is provided with a generally vertically mounted piston and cylinder assembly 212 for raising and lowering the same relative to the lanes 22, 24, 26 for respectively retrieving can ends from lanes 24 and 26 and placing the same in lane 22 as previously described. Additional sliding bearing supports 214 and 216 are provided to either end of support frame 217 to mount the unit 40 for vertical upward and downward movement. Frame 217 is in turn mounted for horizontal movement between lanes 22, 24 and 26 on tracks 220, 222 mounted to an overhead support frame 210. Referring briefly to the lower left-hand portion of FIG. 18A, the support means or fork-like member 83 for supporting a trailing end of the can ends is also provided in each of the lane segments 22*c*, 24*c*, and 26*c*. This latter support fork member 83 is mounted for extending and retracting in a vertical direction relative to the lane by a suitable piston and cylinder assembly 85. This piston and cylinder assembly 85 is activated by the control means 32 at a suitable point responsive to the signals provided by the sensors or sensor means previously described for extending upwardly to support a group of can ends following introduction into the respective outfeed lane segments and yet permit retraction of the end gripping members 92, 94 of the associated transport means or members 36, 46, 56 which deliver the ends thereto from the respective associated intermediate lane segments. It will be noted that the article pressing means or members 194, 195 also readily extend through the open center portions of these fork-like support members 81, 83 so as to engage opposite axial ends of the stick of articles or can ends held therebetween.

As mentioned above, the pick-and-place means is mounted for sliding in opposite directions along the frame 210 for positioning the jaws 192 in alignment with respective ones of outfeed lane segments 22*c*, 24*c* and 26*c* as described above. To this end, elongate track-like mounting assemblies 220, 222 are provided for mounting the frame 217 including the vertical lifting and lowering cylinder 212 and sliding supports 214, 216 for movement into alignment with each of these outfeed lane segments. An additional cylinder 224 is provided for controlling this movement among the various lane outfeed segments.

Figures 12, 19:
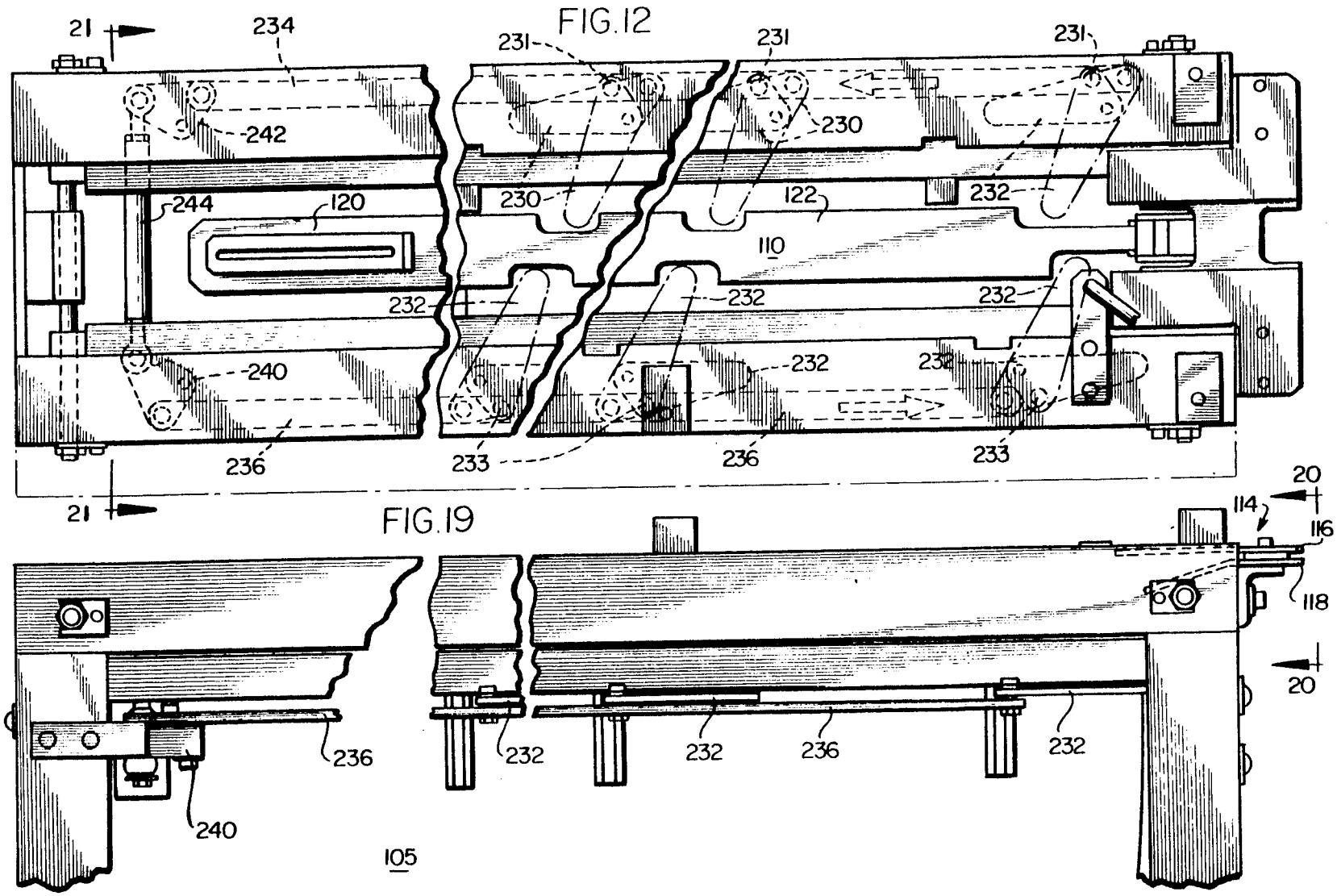
FIG. 12 is a top plan view of the magazine of FIG. 11.
FIG. 19 is a partial side elevational view of the magazine of FIG. 11 showing further details thereof.

Referring now to FIG. 12, a reserve supply means is provided for holding a quantity of bags or packages adjacent outfeed 114 of the magazine 105. The control means 32 coordinates operation of this reserve supply means with the articulate supporting assembly 110. The control is such that the reserve supply receives a quantity of packages from the article supporting assembly 110 as the same is raised to its uppermost position relative to the outfeed. This permits the articulated supporting assembly 110 to return to a lowered position to be refilled with a further quantity of packages. while still providing an uninterrupted supply of packages in the reserve supply adjacent said outfeed for use at the bagging station, while the magazine is being refilled.

Figure 20:
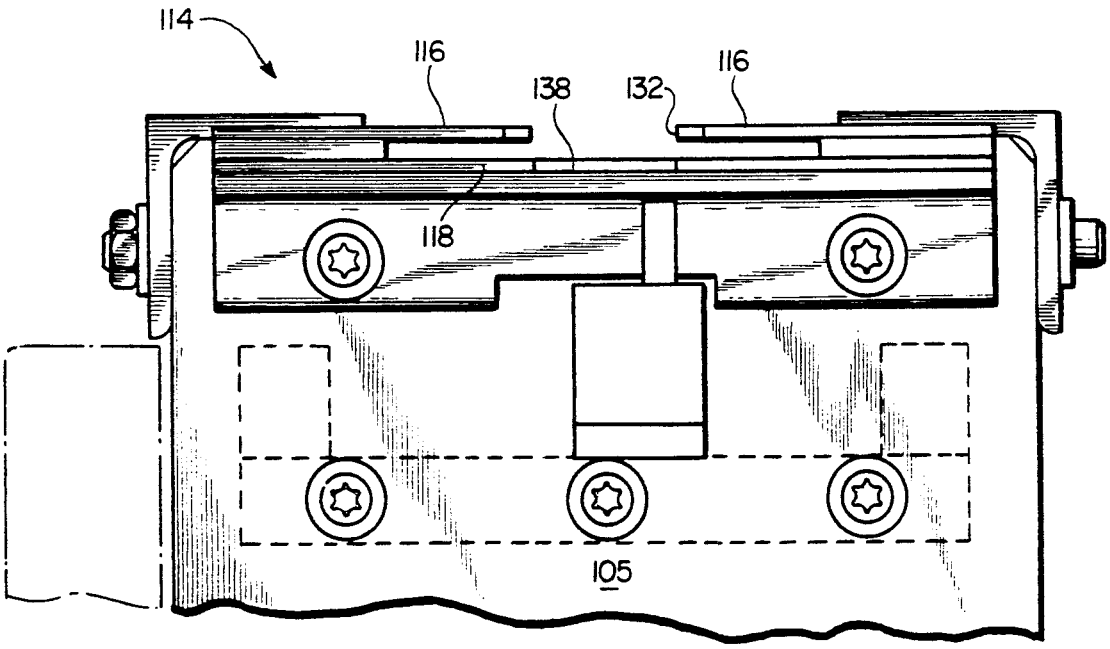
FIG. 20 is an enlarged partial end view of the outfeed end of the magazine of FIG. 11.
Figure 21:
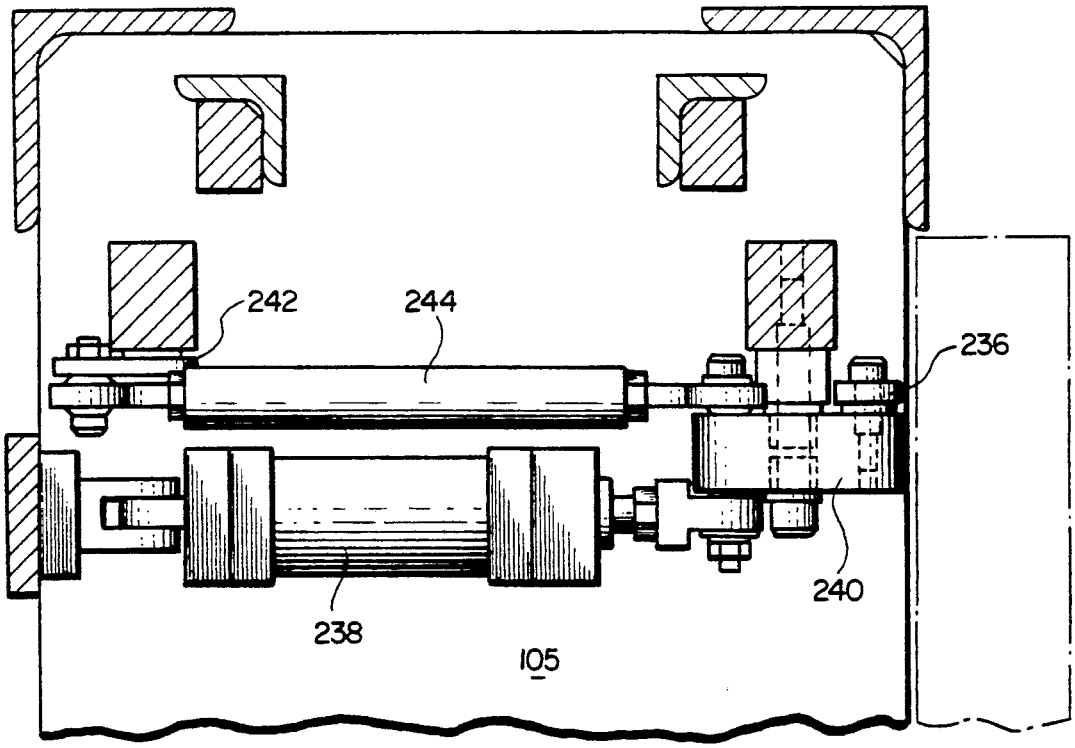
FIG. 21 is a partial sectional view taken generally along the line 21-21 of FIG. 12.

Referring now to FIGS. 12, 19 and 20 the reserve supply means comprises a plurality of pivotally mounted fingers designated generally by reference numerals 230 and 232 arranged to either side of the central open bag-receiving or package-receiving portion of the magazine 105. These fingers 230, 232 are pivoted about their indicated pivot points 231, 233 respectively by respective elongate interconnecting pivot bars or actuator members 234, 236. These bars, as also indicated in FIGS. 11 and 20, and the associated fingers are located generally near a top end portion of the magazine 105. The respective actuator bars 234 and 236 are in turn actuated by a piston and cylinder assembly 238 which activates a pair of cams 240 and 242, the latter through an elongate linkage arm 244. The cam 240 will be seen to be coupled to the actuator bar 236, while the linkage arm 244 actuates the cam 242 which is coupled for driving the actuator bar 234. The respective directions of movement for the actuator bars 234 and 236 for extending the fingers 230, 232 are indicated by the arrows in FIG. 12. The retracted position is illustrated therein in broken line, with the extended position of the fingers 230 and 232 being illustrated in dot-dash line.

The fingers 230, 232 may be pivoted into and out of the open central portion of the magazine 105 for underlying and supporting a remaining quantity of packages or bags when the articulated support assembly 110 has been elevated to the level of fingers 230, 232. It will be seen that the respective support portions 120 and 122 have cutouts arranged to freely pass by the extended fingers 230, 232. Thus, when articulated support member 110 reaches the level of fingers 230, 232 the fingers may be extended to receive and support the remaining supply of bags or packages carried on the support member or assembly 110. The support member assembly 110 may be withdrawn past the extended fingers 230 and 232 to its retracted or bottom-most position as shown in FIG. 11, to receive a further supply of packages. In this manner, a substantially continuous flow or supply of packages is made available at all times at the packaging or bagging station 30.

While particular embodiments of the invention have been shown and described in detail, it will be obvious to those skilled in the art that changes and modifications of the present invention, in its various aspects, may be made without departing from the invention in its broader aspects, some of which changes and modifications being matters of routine engineering or design, and others being apparent only after study. As such, the scope of the invention should not be limited by the particular embodiment and specific construction described herein but should be defined by the appended claims and equivalents thereof. Accordingly, the aim in the appended claims is to cover all such changes nd modifications as fall within the true spirit and scope of the invention.

The invention is claimed as follows:

1. Apparatus for handling and packaging articles such as can ends, said apparatus being capable of receiving a continuous flow of said articles and automatically delivering groups of articles of a prescribed number, disposed in a nested condition, to a packaging station defining a longitudinal axis, said apparatus comprising:

a plurality of generally parallel elongate lanes, each defining a longitudinal axis for simultaneously handling articles;

one of said lanes being coaxially aligned with said packaging station for delivering said articles in an axial direction to said packaging station;

transport means for linearly, axially advancing said articles along at least said one lane toward said packaging station;

pick-and-place means selectively movable between positions in alignment with each of said lanes for selectively transferring articles to said one lane from the others of said lanes;

and control means for controlling a predetermined sequence of operation of said transport means and of said pick-and-place means for providing a substantially continuous supply of articles to said packaging station.

2. Apparatus according to claim 1 and further including a counting station comprising article counting means associated with each of said lanes and wherein said transport means include separating means for engaging and separating successive groups of counted articles as they are counted by said counting station.

3. Apparatus according to claim 1 wherein said transport means comprise means for handling said articles in said groups, each group containing said preselected number of nested articles, and means for linearly advancing each of said groups of articles respectively along each of said lanes.

4. Apparatus according to claim 1 wherein each of said lanes has at least an inlet segment and an outfeed segment, each segment being of a length at least as great as the length of one of said groups of articles for simultaneously accommodating at least two of said groups of articles in each lane; the outfeed segment of said one lane being aligned with and forming an inlet to said packaging station, and said pick-and-place means being operative for transferring groups of articles from said outfeed segments of said others of said lanes to the outfeed segment of said one lane.

5. Apparatus according to claim 4 wherein each of said lanes further includes an intermediate lane segment between said infeed and outfeed segments and of a similar length, and wherein said transport means includes first carriage means operatively associated with each said lane for delivering a group of articles from said inlet lane segment to said intermediate lane segment, for depositing said group of articles at said intermediate lane segment and for thereupon returning to said inlet segment to receive a second group of articles for transport to said intermediate lane segment.

6. Apparatus according to claim 5 wherein said transport means comprises second carriage means for engaging a group of articles in each said intermediate lane segment, for advancing said group of articles to a corresponding outfeed lane segment, for depositing said group of articles in said outfeed lane segment and thereupon returning to said intermediate lane segment to receive a further group of articles for transport to said outfeed lane segment.

7. Apparatus according to claim 1 wherein said pick-and-place means includes gripping means for simultaneously gripping lateral edge portions of all of the members of one of said groups of articles and axial pressing means for pressing oppositely axially inwardly upon opposite axial ends of said group of articles within the gripping means to thereby hold said group of articles within said pick-and-place means.

8. Apparatus according to claim 4 and further including lane sensor means associated with said lanes for developing control signals corresponding to empty ones of said lane segments, said control means being responsive to said control signals for controlling said transport means to advance individual groups of articles along said lanes to fill empty ones of said lane segments.

9. Apparatus according to claim 8 wherein said control means is further responsive to said control signals for operating said pick-and-place means for retrieving a group of articles from a filled one of said outfeed lane segments of said others of said lanes.

10. Apparatus according to claim 9 wherein said control means is responsive to said control signals for causing said pick-and-place means to deliver a group of articles previously retrieved to the outfeed lane segment of said one lane when said outfeed lane segment is empty and when a group of articles is absent from the lane segment immediately preceding said outfeed lane segment, such that a substantially continuous supply of groups of articles is fed to said outfeed lane segment aligned with said packaging station.

11. Apparatus according to claim 1, wherein each of said lanes further includes means for handling a continuous stream of incoming articles and means for counting the number of articles in the incoming stream, thereby providing groups of articles of substantially uniform predetermined count.

12. An article packaging apparatus for packaging a group of articles of a predetermined number disposed in a nested condition in an elongate bag-like package having a folded-over and adhesively secured closed end and an opposite open end, said packaging apparatus comprising:

a magazine for holding a supply of said packages in a stacked condition, said magazine including an articulated supporting assembly for supporting said packages, and an outfeed located toward a topmost end of said magazine;

elevating means for elevating said supporting assembly toward said outfeed of said magazine for removal of the topmost package therefrom;

said articulated supporting assembly including a main support portion for supporting a major portion of said packages and a secondary support portion for supporting at least said folded-over closed end parts of said packages, said secondary support portion being hingedly coupled with said main support portion in articulated fashion; and articulation drive means for controllably varying the angle of said secondary support portion relative to said main support portion as said article supporting assembly is raised and lowered relative to said outfeed for holding the closed end part of at least the topmost one of said packages at a predetermined angle relative to the remaining portion thereof.

13. Apparatus according to claim 12 and further including sensing means positioned for sensing the condition of at least said topmost package relative to a level condition and for producing corresponding control signals; and control means responsive to said control signals for actuating said articulation drive means for varying the angle of said secondary support portion relative to said main support portion to achieve a substantially level condition of said topmost package.

14. Apparatus according to claim 12 and further including package transport means for transporting a package from said magazine to a packaging station to be filled with said group of articles;

movable vacuum means for engaging said closed end of said topmost one of said packages in said magazine and for drawing at least a portion of said closed end through said magazine outfeed;

and movable gripping means for gripping said portion of said closed end drawn through said magazine outfeed by said vacuum means and for drawing the same onto said transport means.

15. Apparatus according to claim 12 and further including package transport means for transporting said packages from said magazine to a packaging station to be filled with said articles;

trough means alignable with said articles at said packaging station for receiving a package from said transport means to be filled thereat;

said trough means having at least one through opening therein, and vacuum means selectively extendable and retractable relative to said through opening for engaging a package in said package transport means and drawing the same onto said trough means to be filled.

16. Apparatus according to claim 12 wherein said packaging station includes bag handling means for opening and positioning an open bag for disposition of a group of articles therein upon movement of said group of articles to the packaging station by said transport means.

17. Apparatus according to claim 16 wherein said bagging station further includes means for closing the bag by folding over the open end of the bag, and tape applying means for sealing said folded-over end in a closed condition.

18. Apparatus according to claim 12 and further including reserve supply means for holding a quantity of said packages adjacent said outfeed of said magazine, and control means for coordinating operation of said reserve supply means with said articulated supporting assembly for receiving a quantity of packages from said articulated supporting assembly, to permit said articulated supporting assembly to return to a position to be refilled with a further quantity of packages, while still providing a supply of packages at said outfeed for use at said bagging station.

19. Article packaging apparatus for packaging an elongate group of articles of a predetermined number disposed in nested condition in an elongate bag-like package having a closed end and an opposite open end, said packaging apparatus comprising:

a magazine for holding a supply of said packages in a stacked condition and having an outlet through which at least the topmost one of said packages may be drawn in a generally longitudinal direction;

package transport means for transporting a package from said magazine to a packaging station to be filled with said group of articles;

movable vacuum means for engaging said closed end of said topmost one of said packages in said magazine and for drawing at least a portion of said closed end through said magazine outlet in a generally longitudinal direction;

and movable gripping means for engaging said portion of said closed end drawn through said magazine outlet by said vacuum means and for drawing the same onto said transport means.

20. Packaging apparatus for depositing a group of articles of predetermined number disposed in nested condition and defining a longitudinal axis in an elongate package having a folded-over and adhesively secured closed end and an opposite open end, said packaging apparatus comprising:

a magazine for holding a supply of said packages;

package transport means for transporting said packages from said magazine to a packaging station to be filled with said articles;

trough means defining a longitudinal axis coaxially aligned with a group of articles at said packaging station for receiving a package from said transport means to be filled thereat;

said trough means having at least one through opening therein, and vacuum means selectively expandable and retractable relative to said through opening for engaging a package in said package transport means and drawing the same onto said trough means to be filled.

21. Apparatus according to claim 20 and further including a filled package discharge area and discharge means engageable with said trough means for discharging a filled package therefrom into said discharge area and thereafter returning the empty trough means into a position for receiving a further package to be filled at said bagging station.

* * * * *